US008013709B2

(12) United States Patent
Tsai et al.

(10) Patent No.: US 8,013,709 B2
(45) Date of Patent: Sep. 6, 2011

(54) CONDUCTIVE MODULE AND ASSEMBLY STRUCTURE HAVING SUCH CONDUCTIVE MODULE

(75) Inventors: Sheng-Nan Tsai, Taoyuan Hsien (TW); Yi-Fan Wu, Taoyuan Hsien (TW); Yung-Sheng Yeh, Taoyuan Hsien (TW); Jia-Li Tsai, Taoyuan Hsien (TW); Chia-Cheng Yang, Taoyuan Hsien (TW); Yung-Yu Chang, Taoyuan Hsien (TW); Tsung-Sheng Yeh, Taoyuan Hsien (TW); Hua-Sheng Lin, Taoyuan Hsien (TW); Chun-Yu Hou, Taoyuan Hsien (TW); Tsung-Hsiao Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/714,441

(22) Filed: Feb. 27, 2010

(65) Prior Publication Data

US 2010/0188830 A1 Jul. 29, 2010

Related U.S. Application Data

(63) Continuation-in-part of application No. 12/413,340, filed on Mar. 27, 2009, now abandoned.

(30) Foreign Application Priority Data

Apr. 18, 2008 (TW) ..... 97114256 A

(51) Int. Cl.

| | |
|---|---|
| ***H01F 27/30*** | (2006.01) |
| ***H01F 27/06*** | (2006.01) |
| ***H01F 21/06*** | (2006.01) |
| ***H01F 21/04*** | (2006.01) |
| ***H01F 27/28*** | (2006.01) |

(52) U.S. Cl. ..... 336/208; 336/65; 336/119; 336/126; 336/196; 336/223

(58) Field of Classification Search ..... 336/62, 336/65, 119, 126, 196, 208, 223, 232
See application file for complete search history.

(56) References Cited

U.S. PATENT DOCUMENTS

| | | | | |
|---|---|---|---|---|
| 5,331,536 | A * | 7/1994 | Lane | 363/126 |
| 6,522,233 | B1 * | 2/2003 | Kyoso et al. | 336/200 |
| 6,578,253 | B1 * | 6/2003 | Herbert | 29/605 |
| 6,765,467 | B2 * | 7/2004 | Ngo et al. | 336/67 |
| 7,439,839 | B2 * | 10/2008 | Podlisk et al. | 336/200 |
| 2007/0176722 | A1 * | 8/2007 | Podlisk et al. | 336/200 |

* cited by examiner

*Primary Examiner* — Anh Mai
*Assistant Examiner* — Ronald Hinson

(57) ABSTRACT

The present invention provides a conductive module used for assembling a magnetic element and an electronic component. The conductive module includes a conductive base, an electronic component and a plurality of conductive units. The electronic component is electrically connected to the conductive base and disposed on one side of the conductive base. The conductive units have respective hollow portions. The conductive units are spaced from each other and fixed on the conductive base such that the hollow portions of the conductive units are aligned with each other to define a channel.

17 Claims, 28 Drawing Sheets

2

CONDUCTIVE MODULE AND ASSEMBLY STRUCTURE HAVING SUCH CONDUCTIVE MODULE

This application is a continuation-in-part of U.S. patent application Ser. No. 12/413,340 filed on Mar. 27, 2009 now abandoned, and entitled "CONDUCTIVE MODULE AND TRANSFORMER HAVING SUCH CONDUCTIVE MODULE". The entire disclosures of the above application are all incorporated herein by reference.

FIELD OF THE INVENTION

The present invention relates to a conductive module, and more particularly to a conductive module for increasing space utilization of the system circuit board. The present invention also relates to an assembly structure having such a conductive module.

BACKGROUND OF THE INVENTION

A transformer has become an essential electronic component for voltage regulation into required voltages for various kinds of electric appliances. Referring to FIG. 1, a schematic exploded view of a conventional transformer disclosed in for example U.S. Pat. No. 7,091,817 is illustrated. The transformer 1 of FIG. 1 principally includes a winding frame member 10, a primary winding coil (not shown), multiple conductive pieces 12 and a magnetic core assembly 13. The winding frame member 10 includes a tube structure 101, a first partition plate 102 and a second partition plate 103. The first partition plate 102 is parallel with second partition plate 103. A winding section 104 is defined between the first partition plate 102, the second partition plate 103 and the external surface of the tube structure 101. In addition, bending pieces 105 and 106 are extended from both edges of the first partition plate 102 and the second partition plate 103, respectively. Accordingly, two guiding slots 107 are formed on opposite sides of the winding frame member 10 for accommodating corresponding conductive pieces 12 therein. The magnetic core assembly 13 includes a first magnetic part 131 and a second magnetic part 132. Each conductive piece 12 is a U-shaped copper piece to be used as the secondary winding coil of the transformer 1. The conductive piece 12 of the transformer 1 is a one-loop structure and includes a hollow portion 121 facing the winding member 121. After the conductive pieces 12 are received in the guiding slots 107 and fixed onto the winding frame member 10, the conductive pieces 12 are electrically connected to a system circuit board (not shown).

Although the transformer 1 is effective for power conversion, there are still some drawbacks. For example, the system circuit board also has an inductor (not shown) to be electrically connected to the output terminal of the secondary winding coil (i.e. the conductive piece 12). Since the transformer 1 fails to be directly connected with the inductor, the transformer 1 and the inductor should be separately mounted on the system circuit board and then electrically connected with each other through designed trace patterns. Due to the separate arrangement of the transformer 1 and the inductor, a lot of layout area of the system circuit board is occupied by the transformer 1 and the inductor. With increasing of electronic industries, electronic devices are developed toward minimization, high operating speed and increased integration level. As a consequence, the requirement of increasing the space utilization of the system circuit board becomes more important. Furthermore, the use of the trace patterns to electrically connect the transformer 1 and the inductor may increase power loss.

Therefore, there is a need of providing a conductive module for increasing space utilization of the system circuit board and a transformer having such a conductive module so as to obviate the drawbacks encountered from the prior art.

SUMMARY OF THE INVENTION

It is an object of the present invention to provide a conductive module for coupling and integrating the transformer and the inductor without additional trace patterns, thereby enhancing the space utilization of the system circuit board and reducing power loss.

Another object of the present invention provides an assembly structure having such a conductive module.

In accordance with an aspect of the present invention, there is provided a conductive module used for assembling a magnetic element and an electronic component. The conductive module includes a conductive base, an electronic component and a plurality of conductive units. The electronic component is electrically connected to the conductive base and disposed on one side of the conductive base. The conductive units have respective hollow portions. The conductive units are spaced from each other and fixed on the conductive base such that the hollow portions of the conductive units are aligned with each other to define a channel.

In accordance with another aspect of the present invention, there is provided an assembly structure of a transformer and an electronic component. The assembly structure includes a primary winding coil, a conductive module, a bobbin and a magnetic core assembly. The conductive module is used for assembling the transformer and the electronic component, and includes a conductive base, the electronic component and a plurality of conductive units. The electronic component is electrically connected to the conductive base and disposed on one side of the conductive base. The conductive units have respective hollow portions. The conductive units are spaced from each other and fixed on the conductive base such that the hollow portions of the conductive units are aligned with each other to define a channel. The bobbin includes a main body having a second channel therein, one or more winding sections arranged on the main body for winding the primary winding coil thereon, and one or more receiving portions arranged on the main body for accommodating the conductive units of the conductive module. The magnetic core assembly is partially embedded into the first channel of the conductive module and the second channel of the bobbin.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
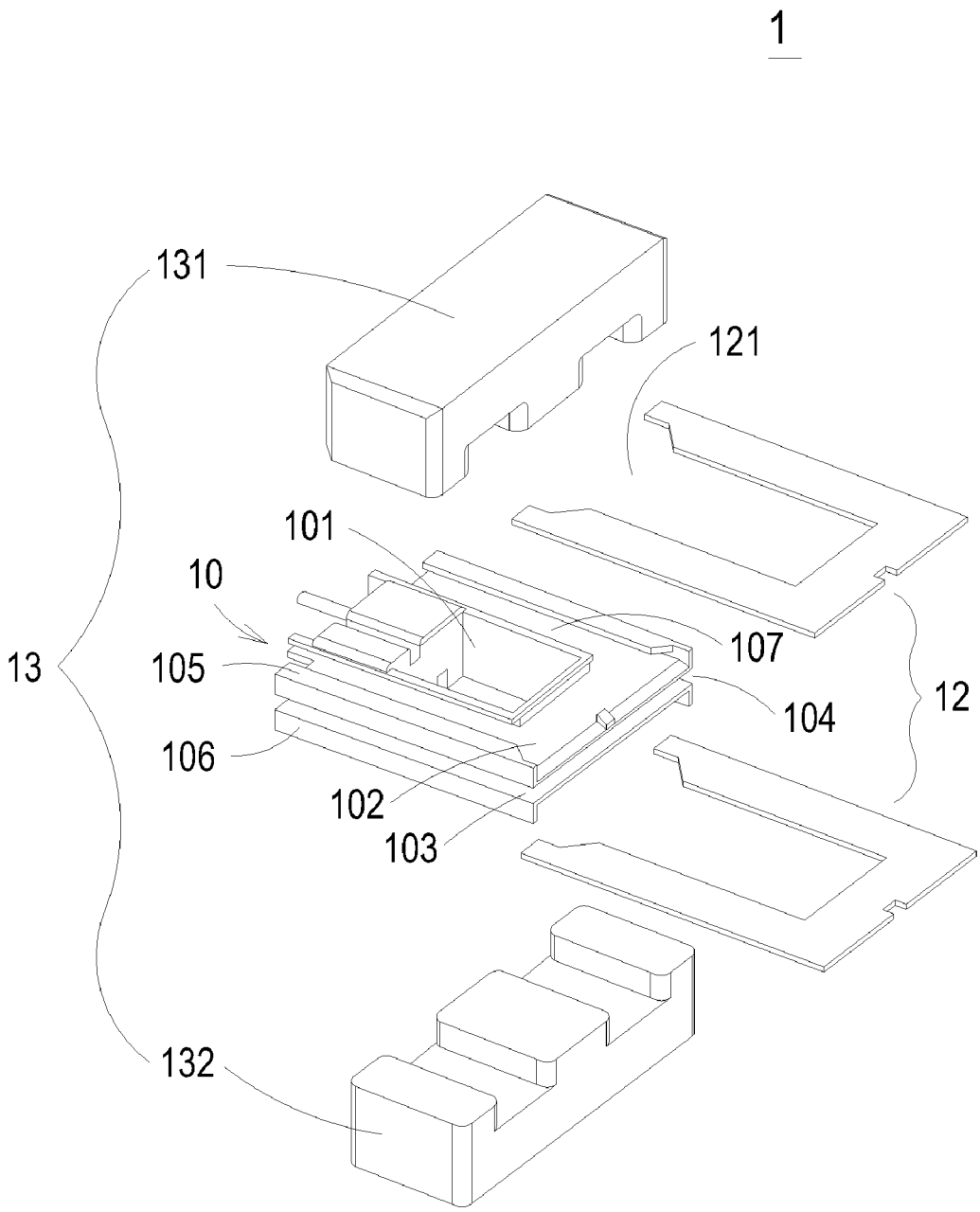
FIG. 1 is a schematic exploded view of a conventional transformer.
Figure 2:
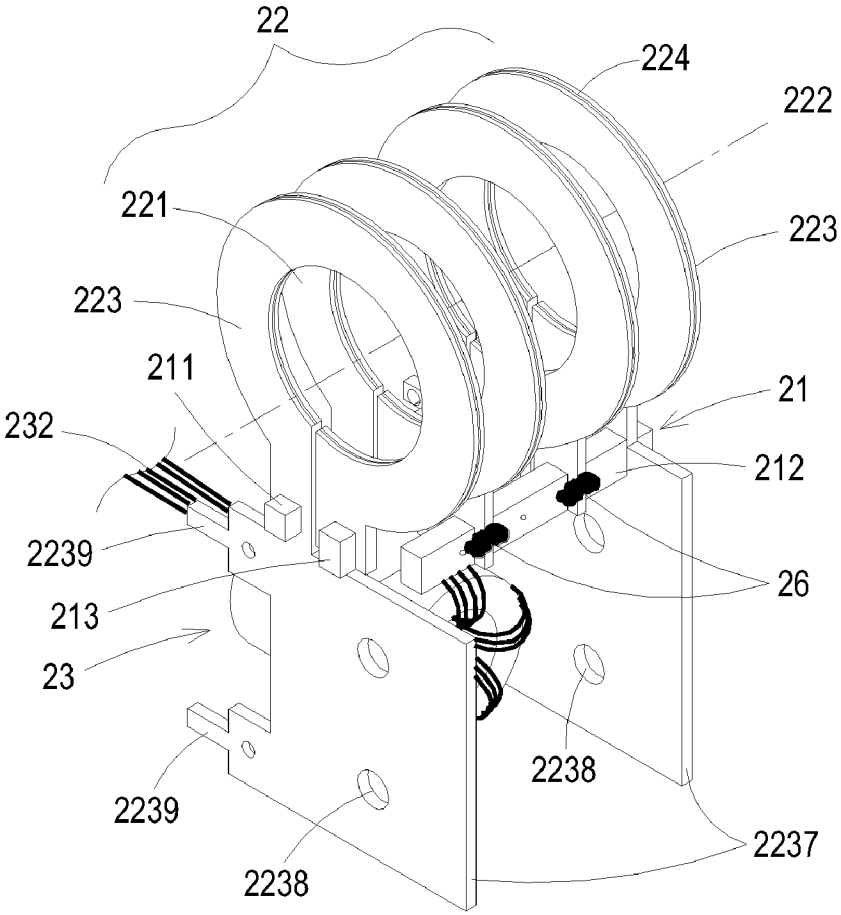
FIG. 2 is a schematic assembled view illustrating a conductive module according to a first preferred embodiment of the present invention.
Figure 5:
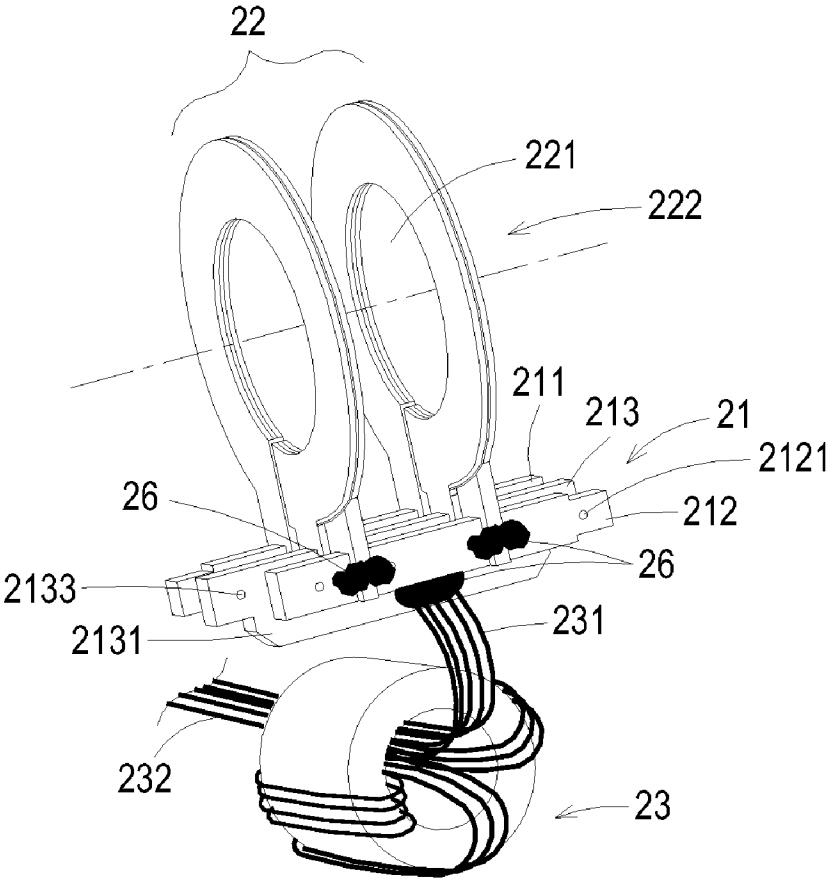
FIG. 5 schematically illustrates a portion of the conductive module shown in FIG. 2.

FIG. 2 is a schematic assembled view illustrating a conductive module according to a first preferred embodiment of the present invention. The conductive module is used for assembling a magnetic element and an electronic component, wherein the magnetic element includes but is not limited to a transformer. The electronic component is included in the structure of the conductive module but is not a part of the transformer. The conductive module 2 principally includes a conductive base 21, a plurality of conductive units 22 and at least one electronic component. An exemplary electronic component includes but is not limited to an inductor 23. The inductor 23 has an outlet part 231 (as shown in FIG. 5) to be coupled with the conductive base 21 and another outlet part 232 to be coupled with a connecting part of a system circuit board.

Figure 3:
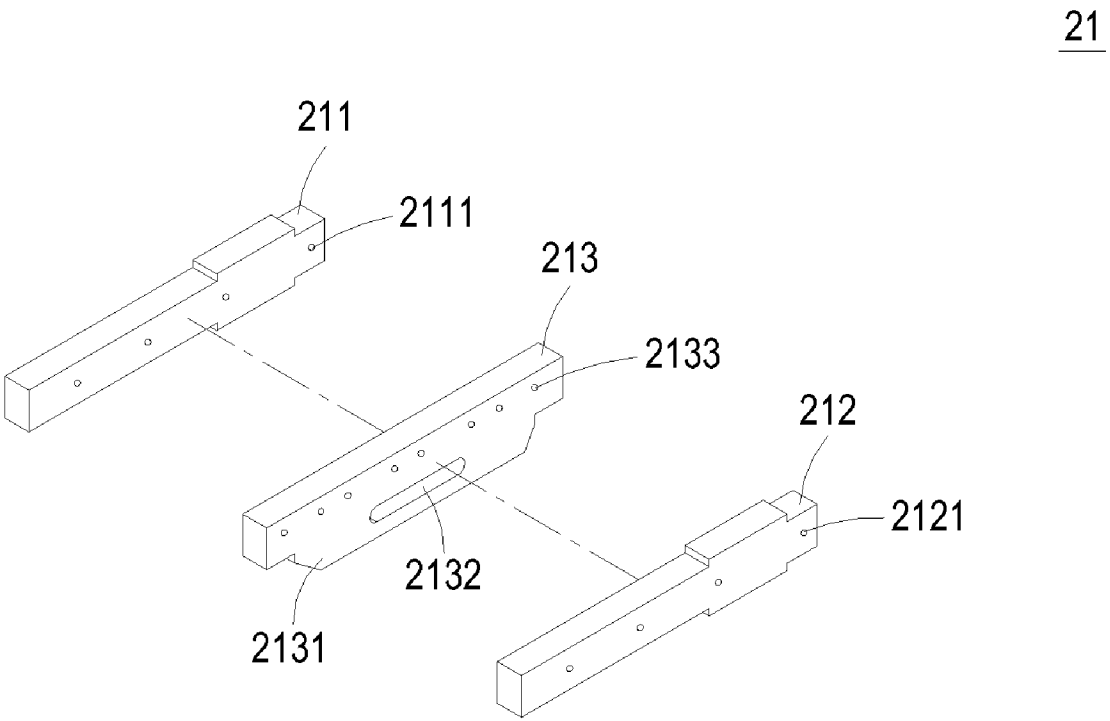
FIG. 3 is a schematic exploded view of the conductive base shown in FIG. 2.

FIG. 3 is a schematic exploded view of the conductive base shown in FIG. 2. Please refer to FIGS. 2, 3 and 5. The conductive units 22 are supported by the conductive base 21. In accordance with the present invention, the conductive base 21 comprises a plurality of conductive rods. In the embodiment of FIG. 3, the conductive base 21 comprises a first conductive rod 211, a second conductive rod 212 and a third conductive rod 213. The third conductive rod 213 is arranged between the first conductive rod 211 and the second conductive rod 212 so as to be coupled with the outlet part 231 of the inductor 23. The outlet part 231 of the inductor 23 is firmly soldered on the third conductive rod 213 via solder paste 26 for example (as shown in FIG. 5), so that the inductor 23 is fixed on one side of the conductive base 21.

For increasing the soldering area, an extension part 2131 is protruded from one side of the third conductive rod 213. In a case that the outlet part 231 of the inductor 23 is soldered on the extension part 2131 of the third conductive rod 213 via the solder paste 26, the area of the third conductive rod 213 to be coated with the solder paste 26 is increased and thus the soldering performance is enhanced. In some embodiments, an opening 2132 is formed in the extension part 2131. The outlet part 231 of the inductor 23 may be penetrated through the opening 2132. During the outlet part 231 of the inductor 23 is soldered on the extension part 2131 of the third conductive rod 213 via the solder paste 26, a portion of the molten solder paste 26 will flow into the opening 2132 so as to enhance the soldering performance.

Figure 4:
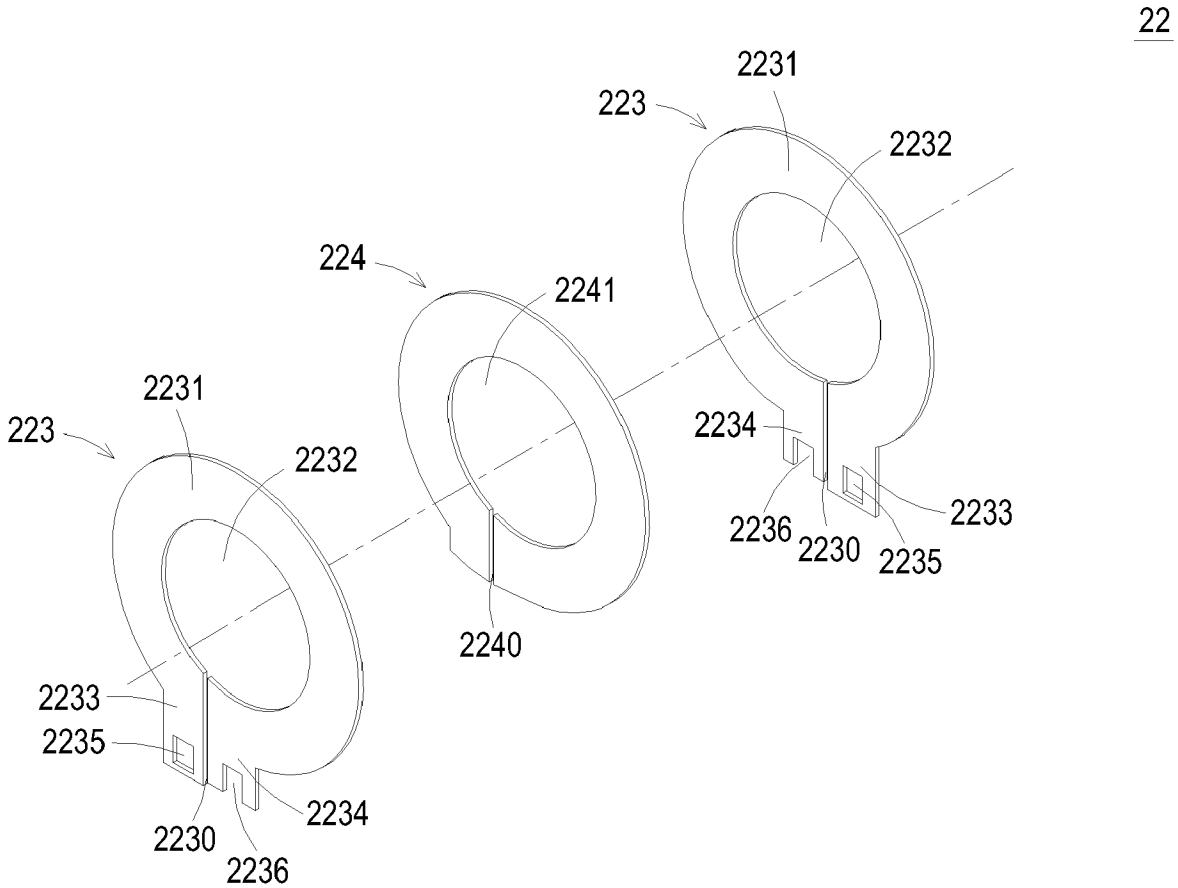
FIG. 4 is a schematic exploded view illustrating a single conductive unit shown in FIG. 2.

FIG. 4 is a schematic exploded view illustrating a single conductive unit shown in FIG. 2. Please refer to FIGS. 2 to 5. Each conductive unit 22 has a hollow portion 221 formed in the center thereof. These conductive units 22 are spaced from each other and fixed on the conductive base 21 opposite to the inductor 23. As such, the hollow portions 221 of these conductive units 22 are aligned with each other to define a channel 222. In this embodiment, the conductive module 2 includes four conductive units 22. The number and the arrangement of the conductive units 22 may be modified or altered while retaining the teachings of the invention.

In some embodiment, each conductive unit 22 includes two conductive pieces 223 and an insulating piece 224. The insulating piece 224 is sandwiched between these two conductive pieces 223. The conductive pieces 223 have complementary shapes. The conductive piece 223 has a ring-shaped, rectangle-shape or a polygon-shaped profile with a seam 2230 and is made of metallic material such as copper. The conductive piece 223 includes a conductive body 2231. A hollow portion 2232 is formed in the center of the conductive body 2231.

In some embodiment, each conductive piece 223 further comprises a first terminal 2233 and a second terminal 2234. The first terminal 2233 and the second terminal 2234 are disposed on bilateral sides of the seam 2230 and coupled with the conductive body 2231. The first terminal 2233 has an engaging hole 2235 to be sheathed around the first conductive rod 211 or the second conductive rod 212. The second terminal 2234 has an engaging notch 2236. The third conductive rod 213 is received in the engaging notch 2236 and fixed on the conductive base 21.

The shape of the insulating piece 224 is substantially the same as the conductive body 2231 of the conductive piece 223. The insulating piece 224 also has a seam 2240 and a hollow portion 2241. The insulating piece 224 is attached onto one of conductive pieces 223 via adhesive for example. The use of the insulating piece 224 may isolate the conductive pieces 223 from each other.

Hereinafter, the process of mounting the plurality of conductive units on the conductive base will be illustrated with reference to FIGS. 2 to 4. First of all, both engaging holes 2235 of each conductive unit 22 are sheathed around the first conductive rod 211 and the second conductive rod 212, respectively. As such, the third conductive rod 213 is received in both engaging notches 2236 of each conductive unit 22. After the plurality of conductive units 22 are mounted on the conductive base 21, the hollow portions 2232 of the conductive pieces 223 and the hollow portions 2241 of the insulating pieces 224 are aligned with each other to define respective hollow portions 221. Meanwhile, the first conductive rod 211, the second conductive rod 212 and the third conductive rod 213 are substantially parallel with each other.

After the plurality of conductive units 22 are mounted on the conductive base 21, the junctions between the conductive pieces 223 and the first conductive rod 211, the second conductive rod 212 and the third conductive rod 213 of the conductive base 21 are coated with solder paste 26 such that the conductive units 22 are soldered onto the conductive base 21. In some embodiments, the first conductive rod 211, the second conductive rod 212 and the third conductive rod 213 of the conductive base 21 have respectively several openings 2111, 2121 and 2133 corresponding to the conductive units 22. During the conductive units 22 are soldered on the conductive base 21, a portion of the molten solder paste 26 will flow into adjacent openings 2111, 2121 and 2133 so as to enhance the soldering performance.

Figure 7:
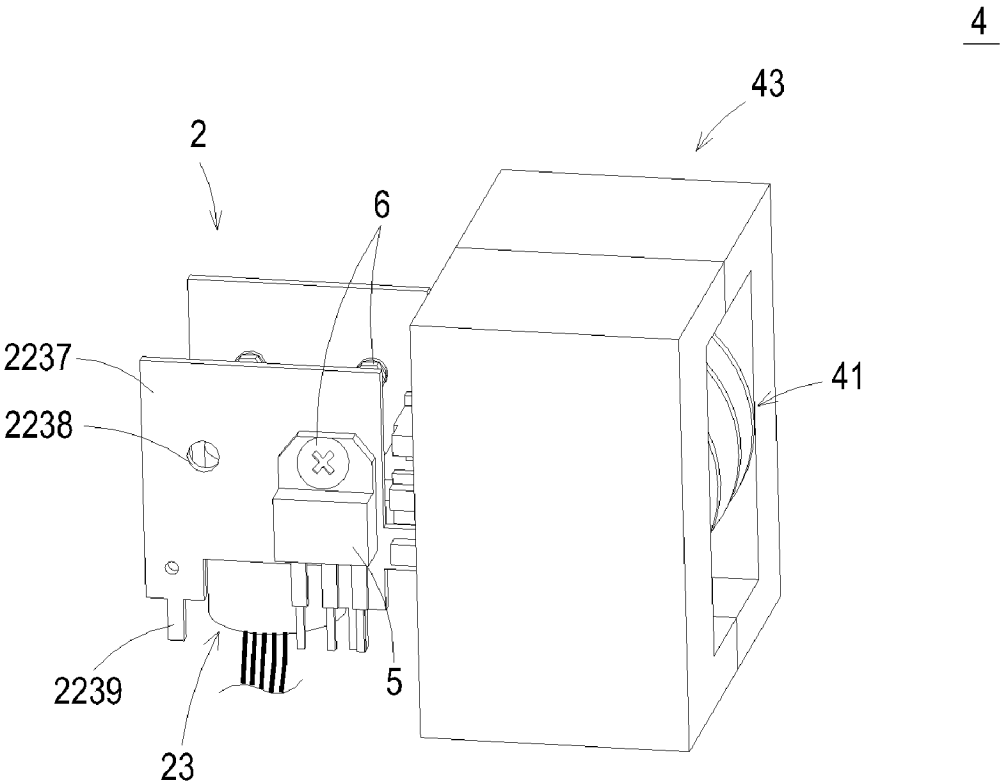
FIG. 7 is a schematic assembled view of the assembly structure of FIG. 6.

Please refer to FIG. 2 again. The outmost conductive pieces 223 of the first and last conductive units 22 have respective extension side plates 2237, which are extended toward the inductor 23 and disposed on bilateral sides of the inductor 23. High power components 5 such as transistors (as shown in FIG. 7) may be supported on the extension side plates 2237 for facilitating heat dissipation. In some embodiments, the extension side plates 2237 have respective screw holes 2238 and pins 2239. By coupling fastening elements 6 such as a screw and nut assembly (as shown in FIG. 7) with corresponding screw holes 2238, the high power components 5 are fixed on the extension side plates 2237. Via the pins 2239, the conductive module 2 may be mounted on the system circuit board (not shown).

Hereinafter, the process of assembling the conductive module 2 of the present invention by using the conductive base 21, the inductor 23 and the conductive units 22 will be illustrated with reference to FIGS. 2 to 4. First of all, the outlet part 231 of the inductor 23 is soldered on the extension part 2131 of the third conductive rod 213 via the solder paste 26. Next, the insulating piece 224 is attached onto one of conductive pieces 223 via adhesive, the engaging hole 2235 of this conductive piece 223 is sheathed around the first conductive rod 211, and the third conductive rod 223 is partially received in the engaging notch 2236 of this conductive piece 223. Next, the engaging hole 2235 of the other conductive piece 223 is sheathed around the second conductive rod 212, the third conductive rod 223 is partially received in the engaging notch 2236 of this conductive piece 223, and the insulating piece 224 is contacted with this conductive piece 223. Meanwhile, a single conductive unit 22 is formed. Next, the conductive unit 22 is fixed on the conductive base 21 via solder paste 26 such that the relative positions of the first conductive rod 211, the second conductive rod 212 and the third conductive rod 213 of the conductive base 21 are retained. The above procedures are repeated until all conductive units 22 are spaced from each other and fixed on the conductive base 21. As such, the hollow portions 221 of these conductive units 22 are aligned with each other to define a first channel 222. In addition, the extension side plates 2237 of the outmost conductive pieces 223 of the first and last conductive units 22 are disposed on bilateral sides of the inductor 23. Meanwhile, the resulting conductive module 2 as shown in FIG. 2 is assembled.

Figure 6:
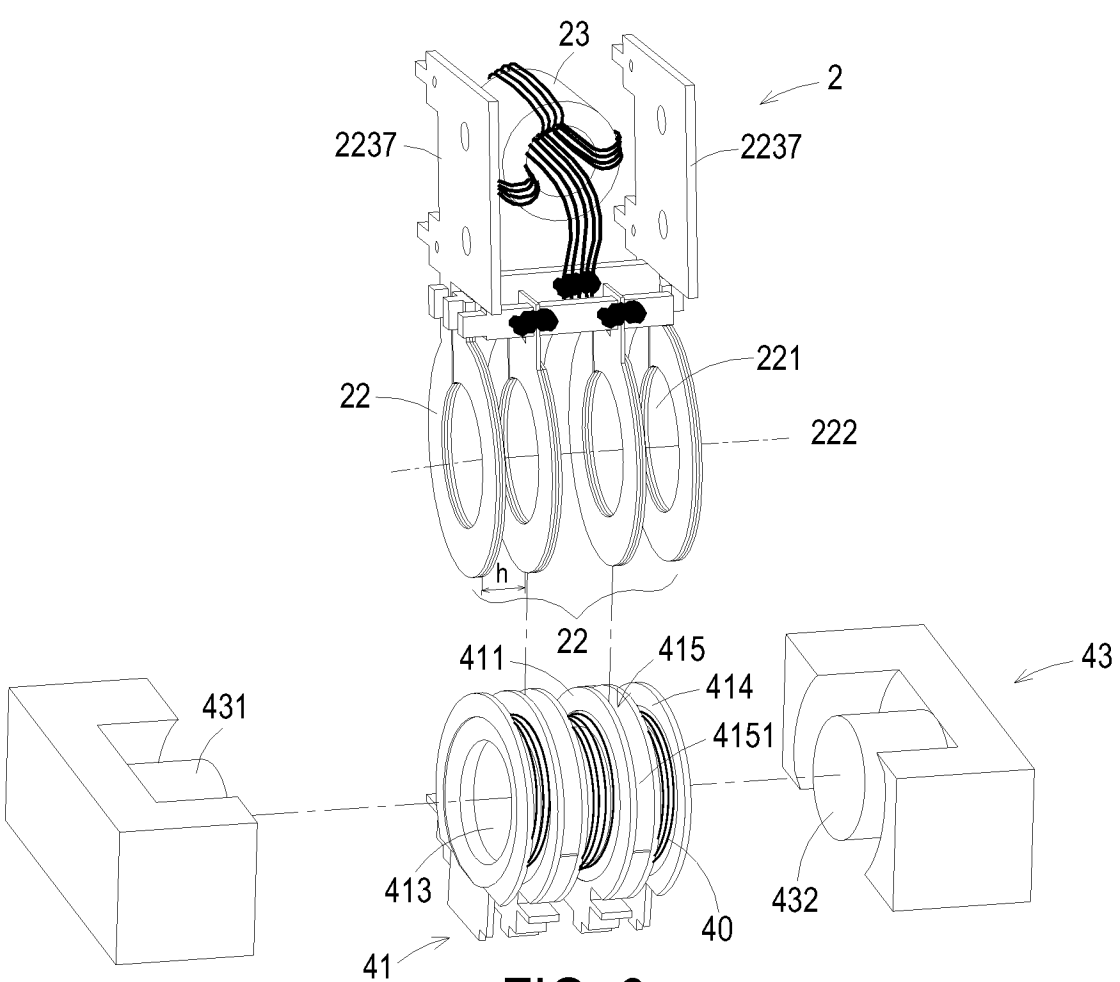
FIG. 6 is a schematic exploded view illustrating an assembly structure of a transformer and an inductor having a conductive module of FIG. 2.

FIG. 6 is a schematic exploded view illustrating an assembly structure of a transformer and an inductor having a conductive module of FIG. 2. FIG. 7 is a schematic assembled view of the assembly structure of FIG. 6. As shown in FIGS. 5 and 6, the assembly structure 4 principally includes a winding coil 40, a bobbin 41, a conductive module 2 and a magnetic core assembly 43. In an embodiment, the winding coil 40 is a primary winding coil and the conductive units 22 of the conductive module 2 are used as a secondary winding coil. The bobbin 41 includes a main body 411, a second channel 413, one or more winding sections 414 and one or more receiving portions 415. The second channel 413 is communicated with the receiving portions 415. The primary winding coil 40 is wound on the winding sections 414. The magnetic core assembly 43 includes a first magnetic part 431 and a second magnetic part 432. In this embodiment, the first magnetic part 431 and the second magnetic part 432 of the magnetic core assembly 43 are cooperatively formed as an EE-type core assembly. The middle portions of the first magnetic part 431 and the second magnetic part 432 are partially embedded into the second channel 413 of the bobbin 41 and communicated with the receiving portions 415. Each receiving portion 415 has an entrance 4151. The cross-sectional length of the entrance 4151 is substantially greater than the diameter of the corresponding conductive unit 22 of the conductive module 2 such that the conductive unit 22 may be inserted into the receiving portion 415 through the entrance 4151. In this embodiment, the conductive units 22 at the bilateral sides of the conductive module 22 may be directly attached on bilateral sides of the bobbin 41 without embedding into the receiving portion 415. Moreover, the gap distance "h" between any two adjacent conductive units 22 is greater than or equal to the width of each winding section 414. The diameter of the hollow portion 221 of the conductive unit 22 is substantially identical to that of the second channel 413 of the bobbin 41. After the conductive units 22 are inserted into the corresponding receiving portions 415 through the entrances 4151, the first channel 222 defined by the hollow portions 221 of the conductive units 22 is communicated with the second channel 413. After the middle portions of the first magnetic part 431 and the second magnetic part 432 are embedded into the second channel 413 of the bobbin 41 and the first channel 222, the assembly structure 4 is completed. As a result, the primary winding coil 40 and the secondary winding coil (i.e. the conductive units 22) interact with the magnetic core assembly 43 to achieve the purpose of voltage regulation.

Since the conductive units 22 of the conductive module 2 and the inductor 23 are both coupled with the third conductive rod 213 of the conductive base 21, the inductive voltage generated by the conductive module 2 may be directly transmitted to the inductor 23. Since no additional trace patterns are required for interconnecting the transformer and the inductor, the space utilization of the system circuit board is enhanced.

Figure 8:
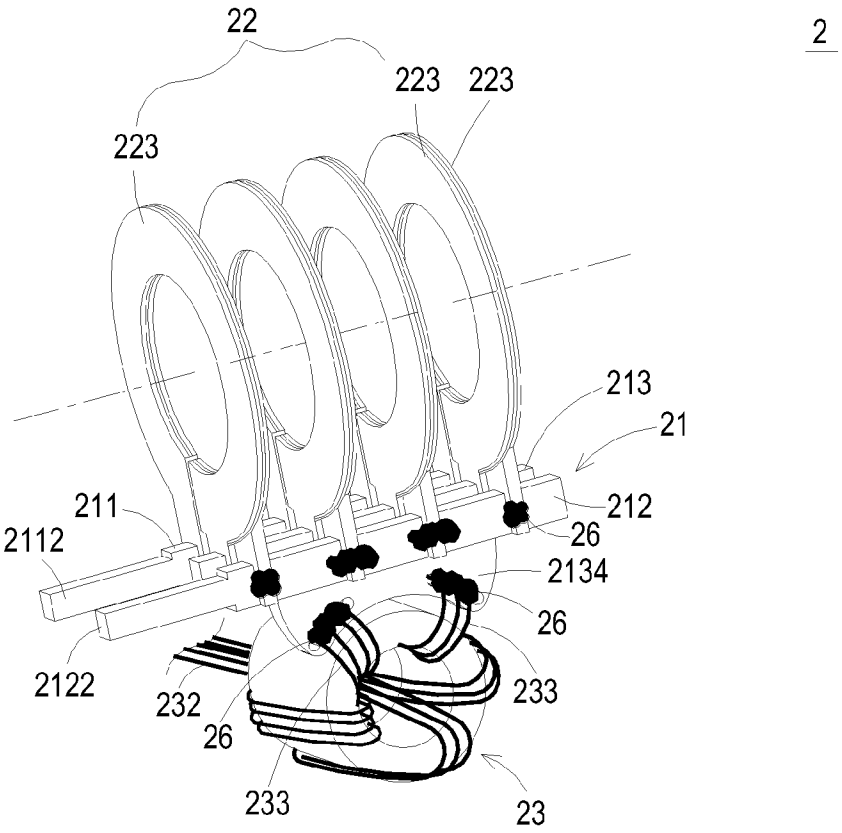
FIG. 8 is a schematic assembled view illustrating a conductive module according to a second preferred embodiment of the present invention.
Figure 9:
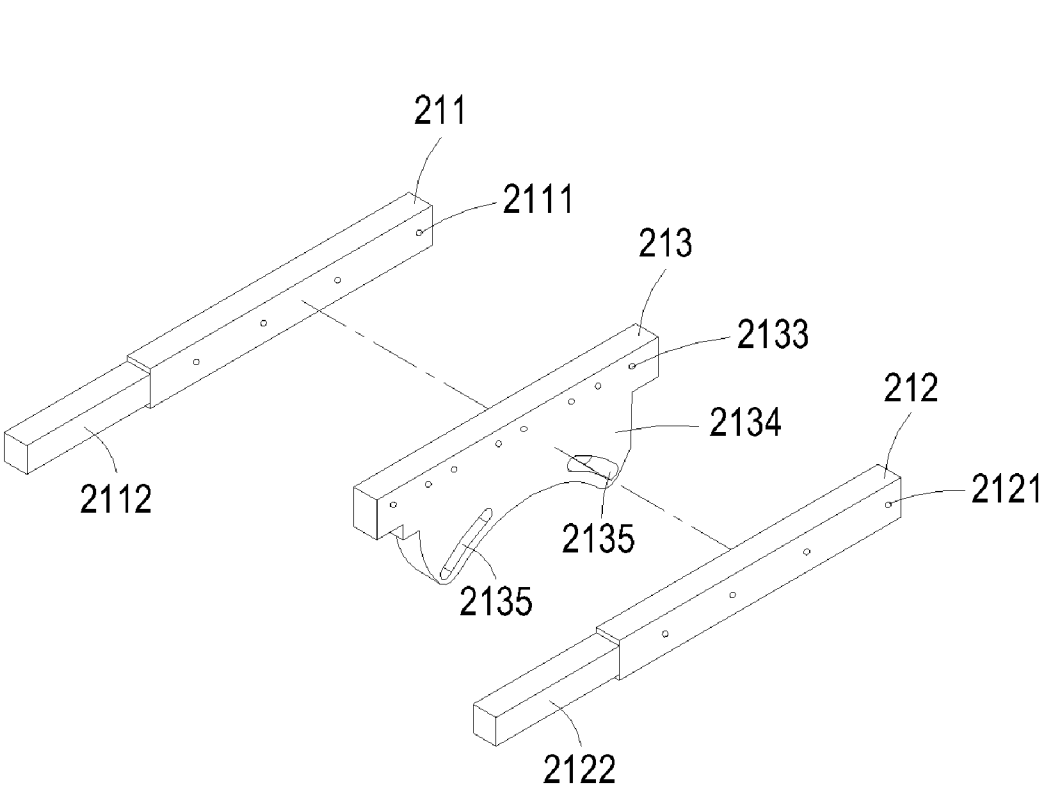
FIG. 9 is a schematic exploded view of the conductive base shown in FIG. 8.

FIG. 8 is a schematic assembled view illustrating a conductive module according to a second preferred embodiment of the present invention. FIG. 9 is a schematic exploded view of the conductive base shown in FIG. 8. Component parts and elements corresponding to those of the first embodiment are designated by identical numeral references, and detailed description thereof is omitted. In this embodiment, the inductor 23 has a plurality of outlet parts 233 to be coupled with the conductive base 21. For increasing the soldering area, an arc-shaped extension part 2134 is protruded from one side of the third conductive rod 213. In a case that the outlet parts 233 of the inductor 23 are soldered on the arc-shaped extension part 2134 of the third conductive rod 213 via the solder paste 26, the area of the third conductive rod 213 to be coated with the solder paste 26 is increased and thus the soldering performance is enhanced. In some embodiments, several openings 2135 are formed in the arc-shaped extension part 2134. The outlet parts 233 of the inductor 23 may be penetrated through the openings 2135. During the outlet parts 233 of the inductor 23 are soldered on the arc-shaped extension part 2134 of the third conductive rod 213 via the solder paste 26, a portion of the molten solder paste 26 will flow into the openings 2135 so as to enhance the soldering performance.

Please refer to FIG. 8 again. The outmost conductive pieces 223 of the first and last conductive units 22 have no extension side plates 2237. Furthermore, the first conductive rod 211 and the second conductive rod 212 have respective first piercing ends 2112 and 2122 to be inserted into corresponding through-holes 30 of a circuit board 3 (as shown in FIG. 10).

Figure 10:
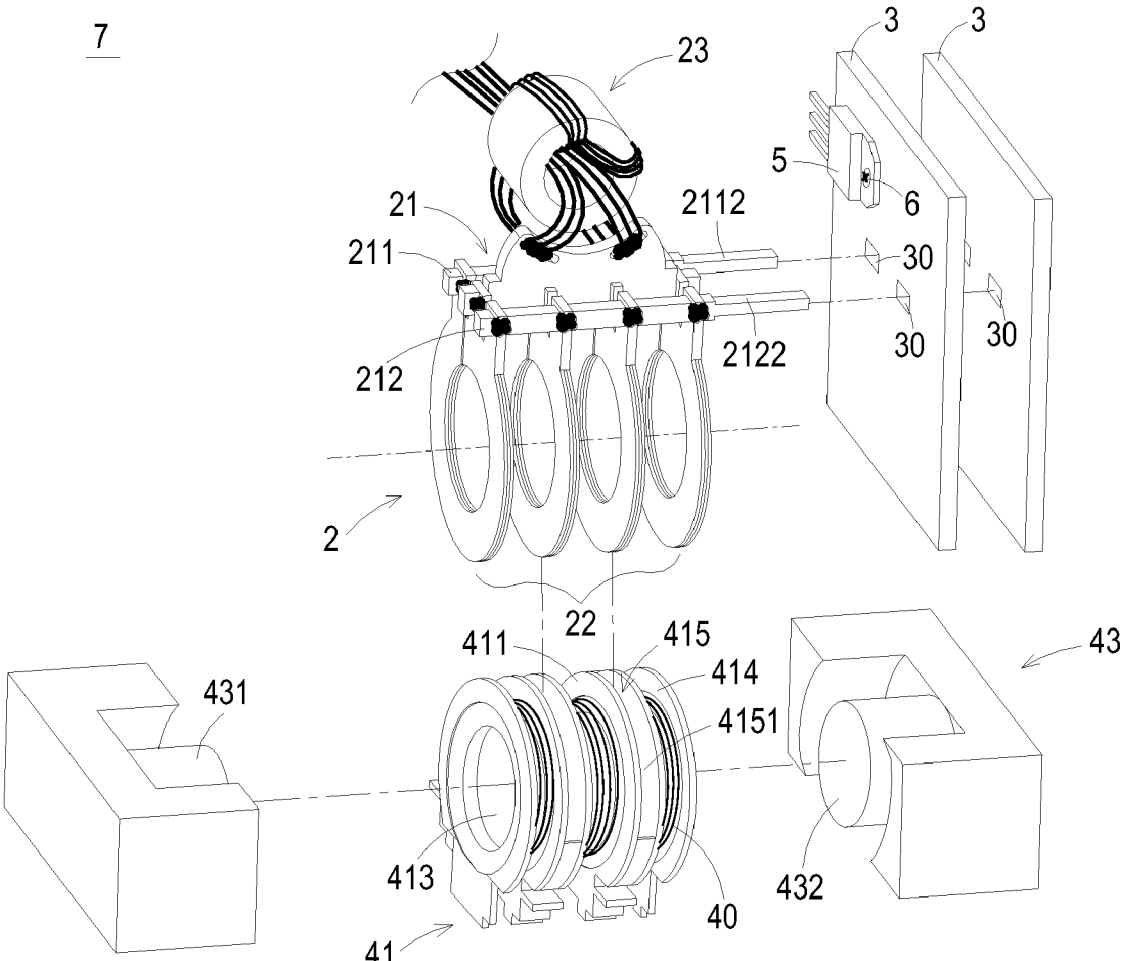
FIG. 10 is a schematic exploded view illustrating an assembly structure of a transformer and an inductor having a conductive module of FIG. 8.
Figure 11:
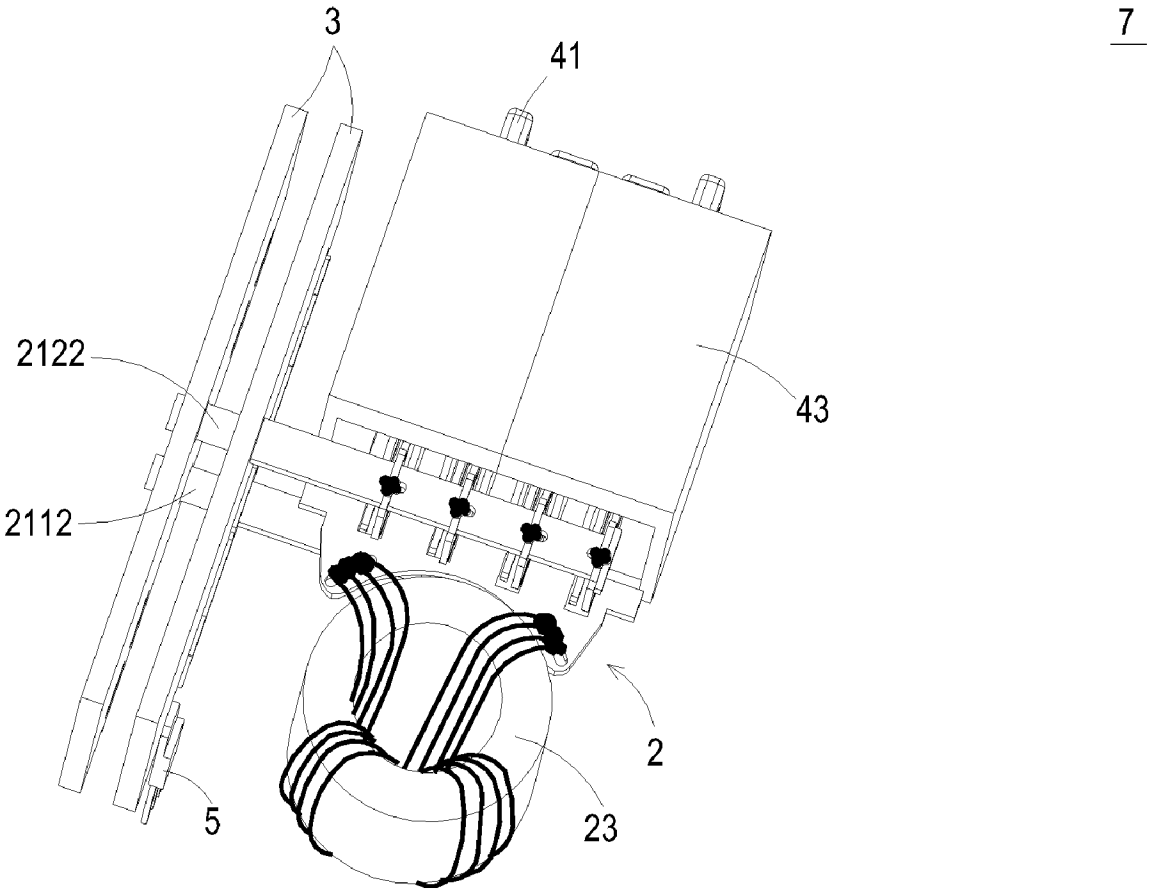
FIG. 11 is a schematic assembled view of the assembly structure of FIG. 8.

FIG. 10 is a schematic exploded view illustrating an assembly structure of a transformer and an inductor having a conductive module of FIG. 8. FIG. 11 is a schematic assembled view of the assembly structure of FIG. 8. As shown in FIGS. 10 and 11, the assembly structure 7 principally includes a primary winding coil 40, a bobbin 41, a conductive module 2 and a magnetic core assembly 43. The configurations of the primary winding coil 40, the bobbin 41 and the magnetic core assembly 43 are identical to those shown in FIG. 6, and are not redundantly described herein. In some embodiments, the assembly structure 7 further includes one or more circuit boards 3 at the same side of the assembly structure 7. The circuit boards 3 have respective through-holes 30. After the first piercing ends 2112 and 2122 of the first conductive rod 211 and the second conductive rod 212 are penetrated through the through-holes 30, the circuit boards 3 are firmly secured on the conductive base 21. In some embodiments, at least one high power component 5 such as a transistor may be mounted on the circuit boards 3 by a fastening elements 6 (e.g. a screw and nut assembly) or according to a surface mount technology. As a consequence, the high power component 5 is electrically connected with the assembly structure 7 through the trace patterns on the circuit boards 3.

Figure 12:
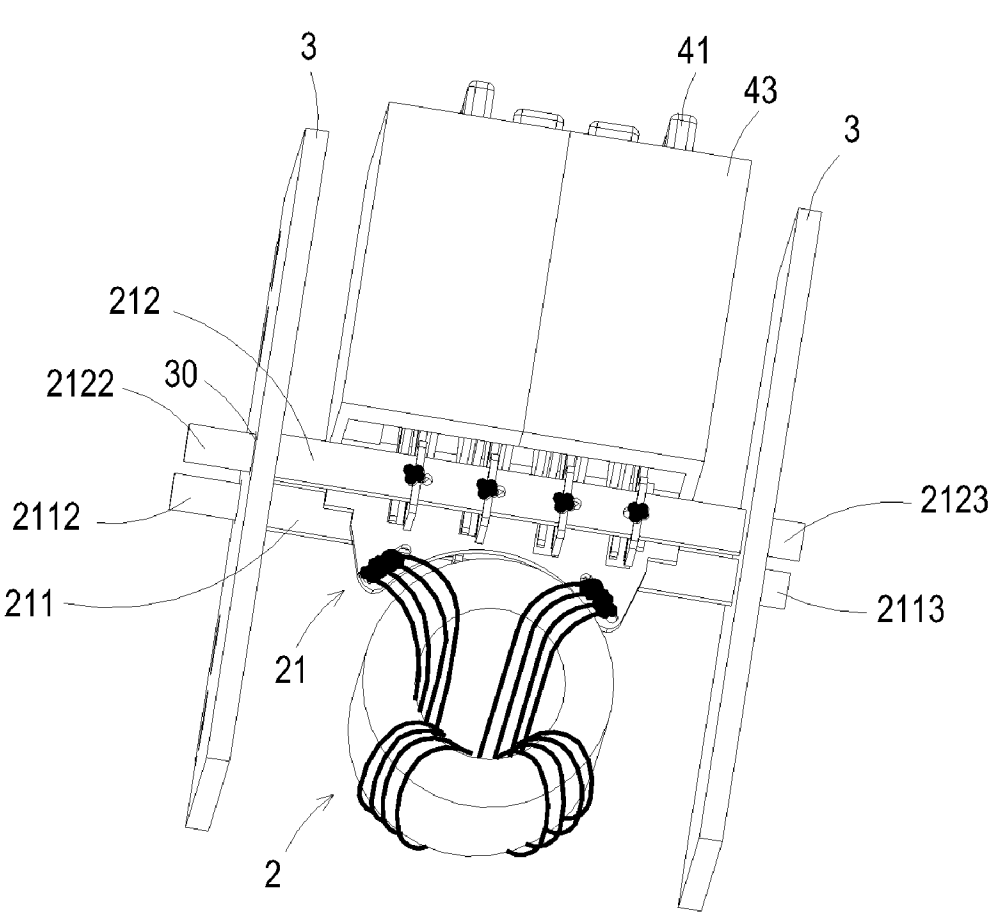
FIG. 12 is a schematic assembled view illustrating an assembly structure of a transformer and an inductor having the conductive module of FIG. 8 according to a further embodiment.

FIG. 12 is a schematic assembled view illustrating an assembly structure of a transformer and an inductor having the conductive module of FIG. 8 according to a further embodiment. As shown in FIG. 12, the circuit boards 3 are disposed on opposite sides of the assembly structure 7. Furthermore, the first conductive rod 211 and the second conductive rod 212 have respective second piercing ends 2113 and 2123, which are opposed to the first piercing ends 2112 and 2122. The second piercing ends 2113 and 2123 are inserted into corresponding through-holes 30 of two circuit boards 3 on opposite sides of the assembly structure 7.

Figure 13:
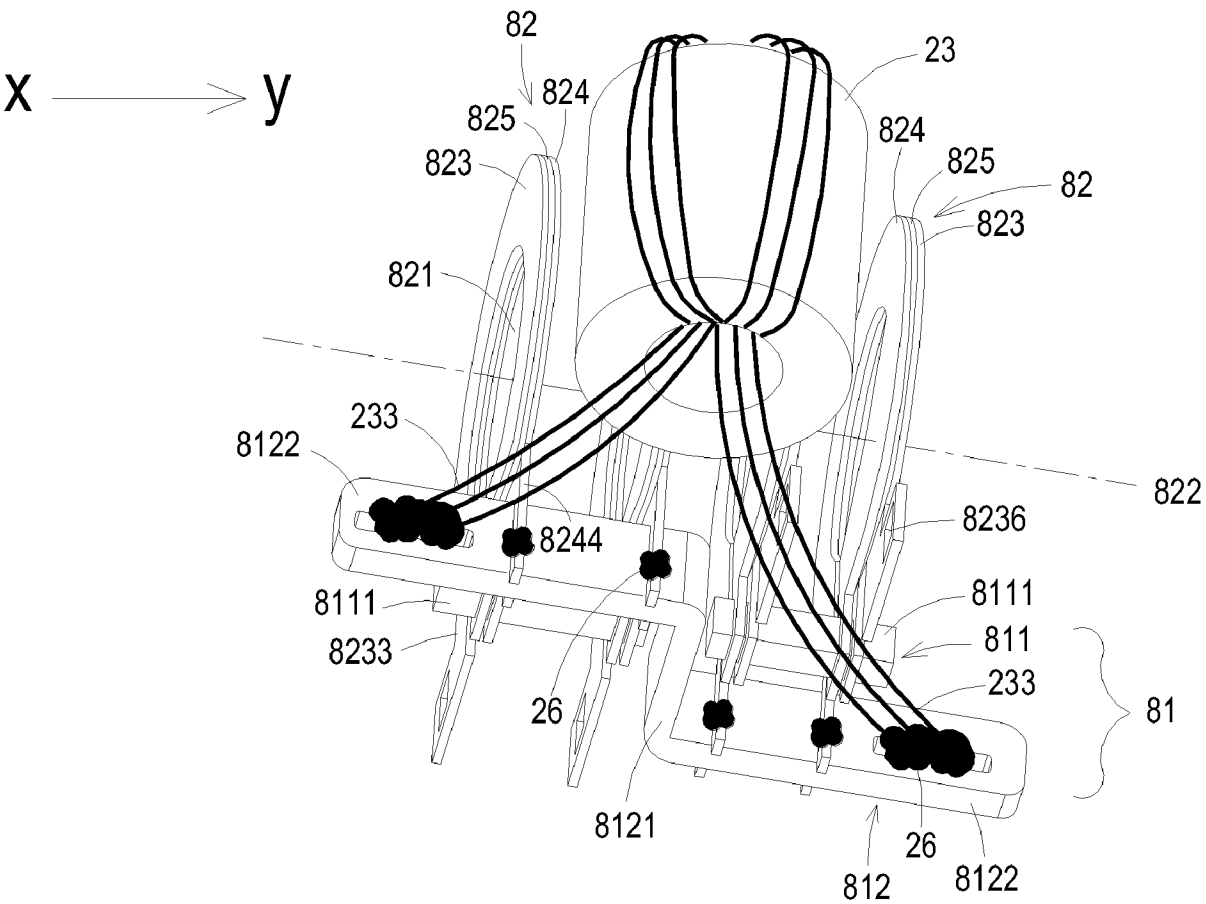
FIG. 13 is a schematic assembled view illustrating a conductive module according to a third preferred embodiment of the present invention.
Figure 14:
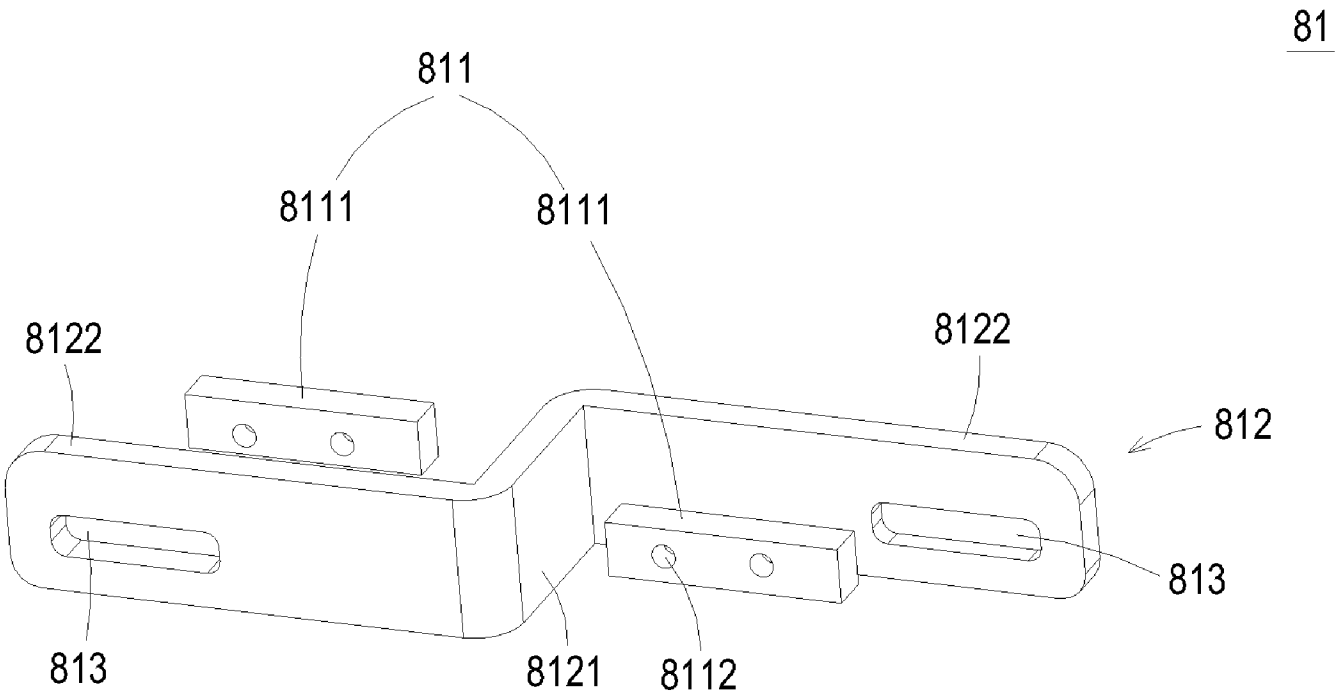
FIG. 14 is a schematic exploded view of the conductive base shown in FIG. 13.

FIG. 13 is a schematic assembled view illustrating a conductive module according to a third preferred embodiment of the present invention. FIG. 14 is a schematic exploded view of the conductive base shown in FIG. 13. The conductive module 8 principally includes a conductive base 81, a plurality of conductive units 82 and at least one electronic component. An exemplary electronic component includes but is not limited to an inductor 23.

In accordance with the present invention, the conductive base 81 comprises a plurality of conductive rods. In the embodiment of FIG. 13, the conductive base 81 comprises a first conductive rod 811 and a second conductive rod 812. The second conductive rod 812 includes a center rod part 8121 and two extension rod parts 8122. The extension rod parts 8122 are substantially perpendicular to the center rod part 8121 and respectively extended from both ends of the center rod part 8121 in opposite directions. The outlet parts 233 of the inductor 23 are firmly soldered on the extension rod parts 8122 via solder paste 26, so that the inductor 23 is fixed on one side of the conductive base 81. The first conductive rod 811 includes two fixed rod parts 8111. The fixed rod parts 8111 are disposed on opposite sides of the center rod part 8121 of the second conductive rod 812 and perpendicular to the center rod part 8121.

In some embodiments, several openings 813 are formed in the two extension rod parts 8122 of the second conductive rod 812. The outlet parts 233 of the inductor 23 may be penetrated through the openings 813. During the outlet parts 233 of the inductor 23 are soldered on the extension rod parts 8122 of the second conductive rod 812 via the solder paste 26, a portion of the molten solder paste 26 will flow into the openings 813 so as to enhance the soldering performance.

Figure 15:
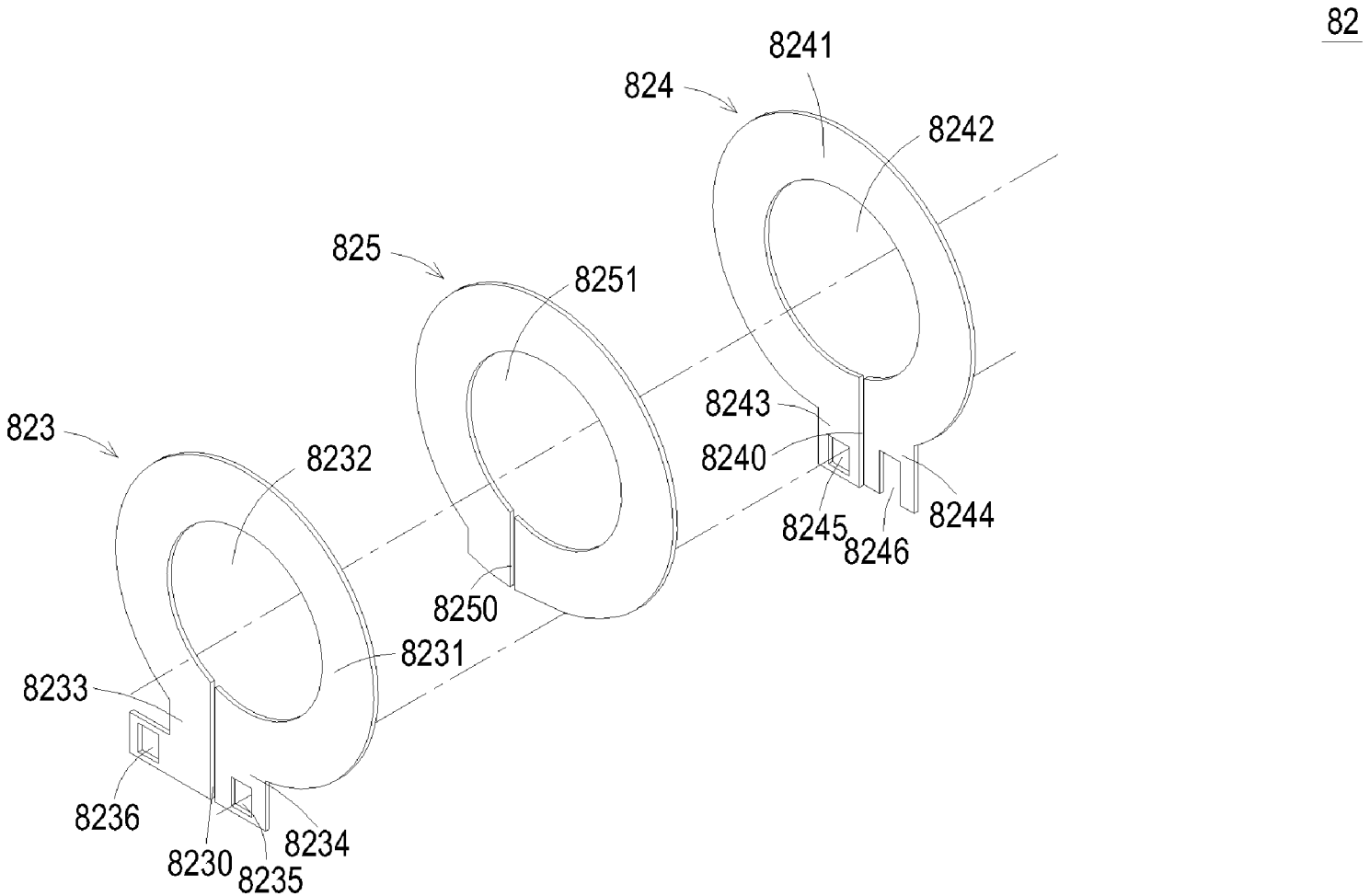
FIG. 15 is a schematic exploded view illustrating a single conductive unit shown in FIG. 13.

FIG. 15 is a schematic exploded view illustrating a single conductive unit shown in FIG. 13. Please refer to FIGS. 13 to 15. Each conductive unit 82 has a hollow portion 821 formed in the center thereof. These conductive units 82 are spaced from each other and fixed on the conductive base 81 opposite to the inductor 23. As such, the hollow portions 821 of these conductive units 82 are aligned with each other to define a channel 822. In this embodiment, the conductive module 8 includes four conductive units 82. The number and the arrangement of the conductive units 82 may be modified or altered while retaining the teachings of the invention.

In some embodiment, each conductive unit 82 includes a first conductive piece 823, a second conductive piece 824 and an insulating piece 825. The insulating piece 825 is sandwiched between the first conductive piece 823 and the second conductive piece 824. The first conductive piece 823 has a ring-shaped, rectangle-shape or a polygon-shaped profile with a seam 8230 and is made of metallic material such as copper. The first conductive piece 823 includes a conductive body 8231. A hollow portion 8232 is formed in the center of the conductive body 8231.

Figure 16:
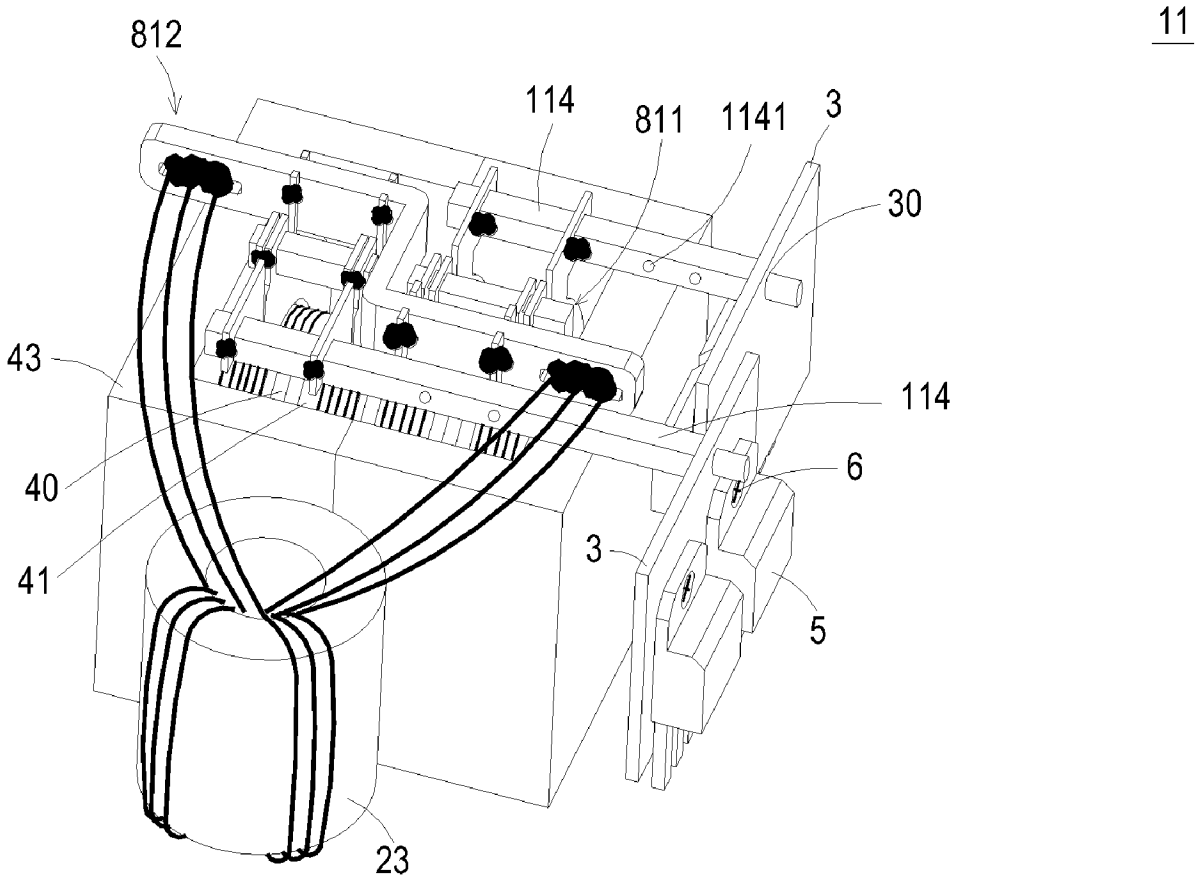
FIG. 16 is a schematic assembled view illustrating an assembly structure of a transformer and an inductor having a conductive module of FIG. 13.

In some embodiment, the first conductive piece 823 further comprises a first terminal 8233 and a second terminal 8234. The first terminal 8233 and the second terminal 8234 are disposed on bilateral sides of the seam 8230 and coupled with the conductive body 8231. The second terminal 8234 has an engaging hole 8235 to be sheathed around the fixed rod parts 8111 of the first conductive rod 811. The first terminal 8233 has an auxiliary hole 8236 to be sheathed around an auxiliary rod 114 (as shown in FIG. 16).

The second conductive piece 824 also has a ring-shaped, rectangle-shape or a polygon-shaped profile with a seam 8240 and is made of metallic material such as copper. The second conductive piece 824 includes a conductive body 8241. A hollow portion 8242 is formed in the center of the conductive body 8241.

In some embodiment, the second conductive piece 824 further comprises a first terminal 8243 and a second terminal 8244. The first terminal 8243 and the second terminal 8244 are disposed on bilateral sides of the seam 8240 and coupled with the conductive body 8241. The first terminal 8243 has an engaging hole 8245 to be sheathed around the fixed rod parts 8111 of the first conductive rod 811. The second terminal 8244 has an engaging notch 8246. The extension rod part 8122 of the second conductive rod 812 is received in the engaging notch 8246. After the first conductive piece 823, the second conductive piece 824 and the insulating piece 825 are cooperatively combined as the conductive unit 82, any fixed rod part 8111 of the first conductive rod 811 is penetrated through the engaging hole 8235 of the first conductive piece 823 and the engaging hole 8245 of the second conductive piece 824. In addition, any center rod part 8121 of the second conductive rod 812 is received in the engaging notch 8246 of the second conductive piece 824 and coupled to the conductive base 81. Meanwhile, the first terminal 8233 of the first conductive piece 823 and the second terminal 8244 of the second conductive piece 824 are opposed to each other with respect to the fixed rod part 8111 of the first conductive rod 811. In some embodiments, the junctions between the first conductive piece 823, the second conductive piece 824, the fixed rod parts 8111 of the first conductive rod 811 and the extension rod part 8122 of the second conductive rod 812 are coated with solder paste 26 such that the conductive units 82 are soldered onto the conductive base 81.

The shape of the insulating piece 825 is substantially the same as the conductive body 8231 of the first conductive piece 823 and the conductive body 8241 of the second conductive piece 824. The insulating piece 825 also has a seam 8250 and a hollow portion 8251. The insulating piece 825 is attached onto the conductive body 8231 of the first conductive piece 823 or the conductive body 8241 of the second conductive piece 824 via adhesive for example. The use of the insulating piece 825 may isolate the first conductive piece 823 from the second conductive piece 824. The hollow portion 8232 of the first conductive piece 823, the hollow portion 8242 of the second conductive piece 824 and the hollow portion 8251 of the insulating piece 825 are aligned with each other to define the hollow portion 821 of the conductive unit 82.

In some embodiments, the first conductive rod 811 has respectively several openings 8112 (as shown in FIG. 14). During the conductive units 82 are soldered on the conductive base 81, a portion of the molten solder paste 26 will flow into adjacent openings 8112 so as to enhance the soldering performance.

Hereinafter, the process of assembling the conductive module 8 of the present invention by using the conductive base 81, the inductor 83 and the conductive units 82 will be illustrated with reference to FIGS. 13 to 15. For clarification, the four conductive units 82 are referred as first, second, third and fourth conductive units from the point x along the y direction. First of all, the first conductive pieces 823, the second conductive pieces 824 and the insulating pieces 825 are combined as respective conductive units. Next, one fixed rod part 8111 of the first conductive rod 811 is penetrated through the engaging holes 8235 and 8245 of the first and second conductive pieces 823 of the first and second conductive units. In addition, the other fixed rod part 8111 of the first conductive rod 811 is penetrated through the engaging holes 8235 and 8245 of the first and second conductive pieces 823 of the third and fourth conductive units. Next, the first, second, third and fourth conductive units are soldered on corresponding fixed rod parts 8111 of the first conductive rod 811 via the solder paste 26. Next, the third and fourth conductive units are reversely arranged with respect to the first and second conductive units such that the engaging notches 8246 of the second conductive pieces 824 of the first and second conductive units and the auxiliary holes 8236 of the first conductive pieces 823 of the third and fourth conductive units are arranged at the same side of the first conductive rod 811 (as shown in FIG. 14). Next, one extension rod part 8122 of the second conductive rod 812 are partially received in the engaging notches 8246 of the first and second conductive units and the other extension rod part 8122 of the second conductive rod 812 are partially received in the engaging notches 8246 of the third and fourth conductive units. Next, the second conductive rod 812 is fixed on the first, second, third and fourth conductive units via the solder paste 26. Meanwhile, the conductive units 82 are fixed on the conductive base 81 such that the relative positions of the first conductive rod 811 and the second conductive rod 812 of the conductive base 81 are retained. As such, all conductive units 81 are spaced from each other and fixed on the conductive base 81 such that the hollow portions 821 of these conductive units 81 are aligned with each other to define a first channel 822. Afterwards, the outlet parts 233 of the inductor 23 are fixed on corresponding extension rod parts 8122 of the second conductive rod 812. Meanwhile, the resulting conductive module 8 as shown in FIG. 13 is assembled.

FIG. 16 is a schematic assembled view illustrating an assembly structure of a transformer and an inductor having a conductive module of FIG. 13. As shown in FIGS. 13 to 16, the assembly structure 11 principally includes a primary winding coil 40, a bobbin 41, a conductive module 8 and a magnetic core assembly 43. The configurations of the primary winding coil 40, the bobbin 41 and the magnetic core assembly 43 are identical to those shown in FIG. 6, and are not redundantly described herein.

As shown in FIG. 16, the assembly structure 11 further comprises several auxiliary rods 114. An auxiliary rod 114 is penetrated through the auxiliary holes 8236 of the first conductive pieces 823 of the first and second conductive units. Another auxiliary rod 114 is penetrated through the auxiliary holes 8236 of the first conductive pieces 823 of the third and fourth conductive units 82. These two auxiliary rods 114 are arranged at bilateral sides of the conductive base 81 and substantially parallel with the first conductive rod 811 of the conductive base 81. In some embodiments, the assembly structure 11 further includes one or more circuit boards 3 at the same side of the assembly structure 11. The circuit boards 3 have respective through-holes 30. After the auxiliary rods 114 are penetrated through the through-holes 30, the circuit boards 3 are firmly secured on the conductive base 81. In some embodiments, at least one high power component 5 such as a transistor may be mounted on the circuit boards 3 by a fastening elements 6 (e.g. a screw and nut assembly) or according to a surface mount technology. As a consequence, the high power component 5 is electrically connected with the assembly structure 11 through the trace patterns on the circuit boards 3.

In some embodiments, the auxiliary rods 114 are fixed on the corresponding conductive units 82 via the solder paste 26.

Furthermore, several openings 1141 are formed in respective auxiliary rods 114. During the auxiliary rods 114 are soldered on corresponding conductive units 82 via the solder paste 26, a portion of the molten solder paste 26 will flow into the openings 1141 so as to enhance the soldering performance.

Figure 17:
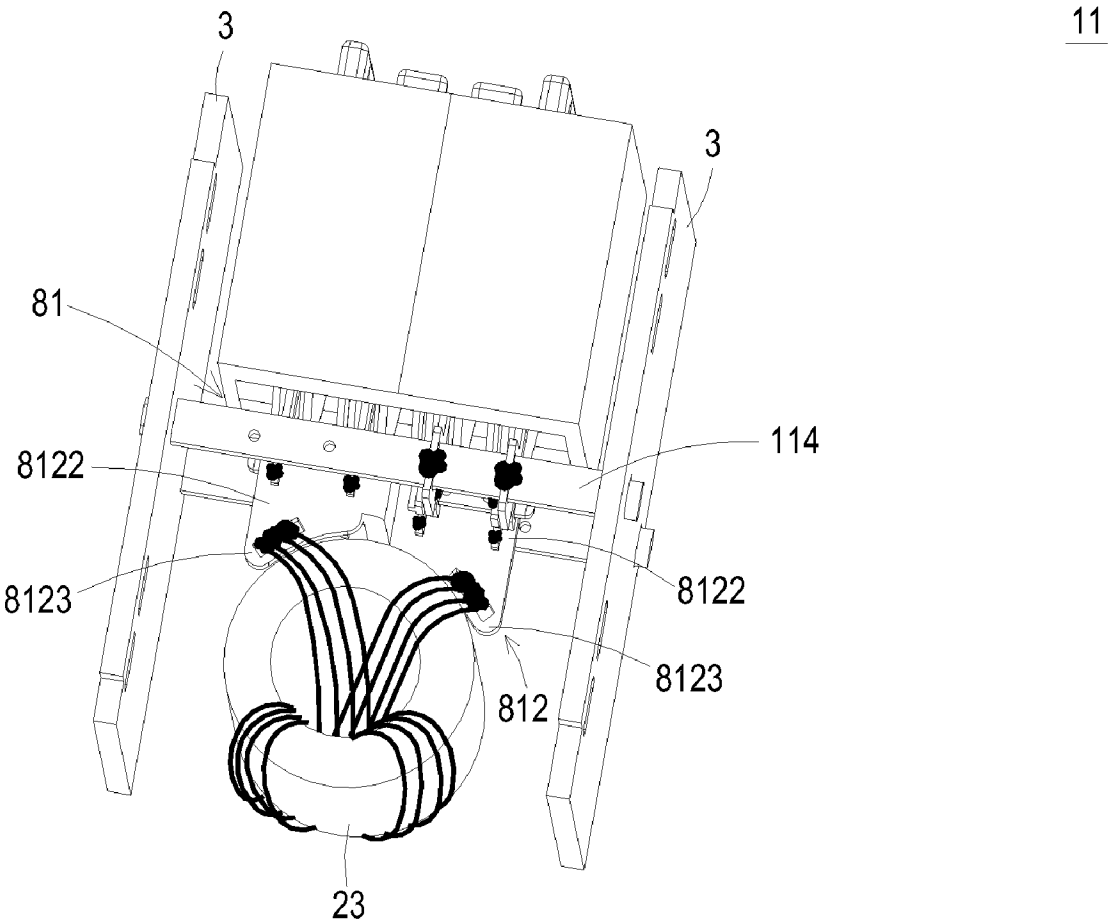
FIG. 17 is a schematic assembled view illustrating an assembly structure having the conductive module of FIG. 13 according to a further embodiment.

FIG. 17 is a schematic assembled view illustrating an assembly structure of a transformer and an inductor having the conductive module of FIG. 13 according to a further embodiment. The inductor 23 is disposed on one side of the second conductive rod 812 of the conductive base 81. An arc-shaped extension part 8123 is protruded from one side of the second conductive rod 812 of the conductive base 81. In a case that the outlet parts 233 of the inductor 23 are soldered on the arc-shaped extension part 8123 via the solder paste 26, the area of the second conductive rod 812 to be coated with the solder paste 26 is increased and thus the soldering performance is enhanced. Furthermore, as shown in FIG. 17, the circuit boards 3 are disposed on opposite sides of the assembly structure 11. The auxiliary rods 114 are inserted into corresponding through-holes 30 of two circuit boards 3 on opposite sides of the assembly structure 11.

Figure 18:
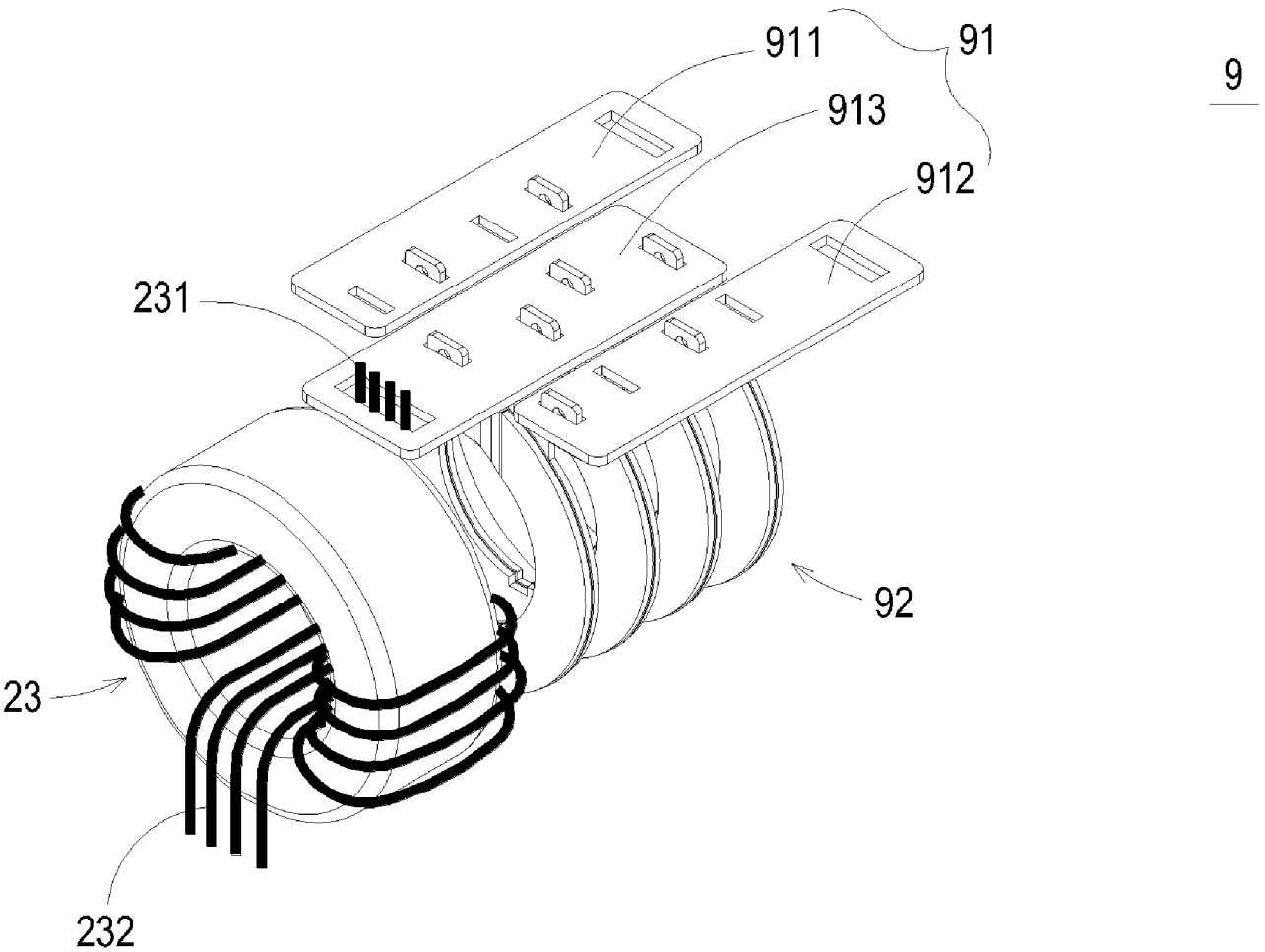
FIG. 18 is a schematic assembled view illustrating a conductive module according to a fourth preferred embodiment of the present invention.

FIG. 18 is a schematic assembled view illustrating a conductive module according to a fourth preferred embodiment of the present invention. The conductive module is used for assembling a magnetic element and an electronic component, wherein the magnetic element includes but is not limited to a transformer. The electronic component is included in the structure of the conductive module but is not a part of the transformer. The conductive module 9 principally includes a conductive base 91, a plurality of conductive units 92 and at least one electronic component. An exemplary electronic component includes but is not limited to an inductor 23. The inductor 23 has an outlet part 231 to be coupled with the conductive base 21 and another outlet part 232 to be coupled with a connecting part of a system circuit board. In this embodiment, the conductive units 92 and the inductor 23 are disposed at the same side of the conductive base 91.

Figure 19:
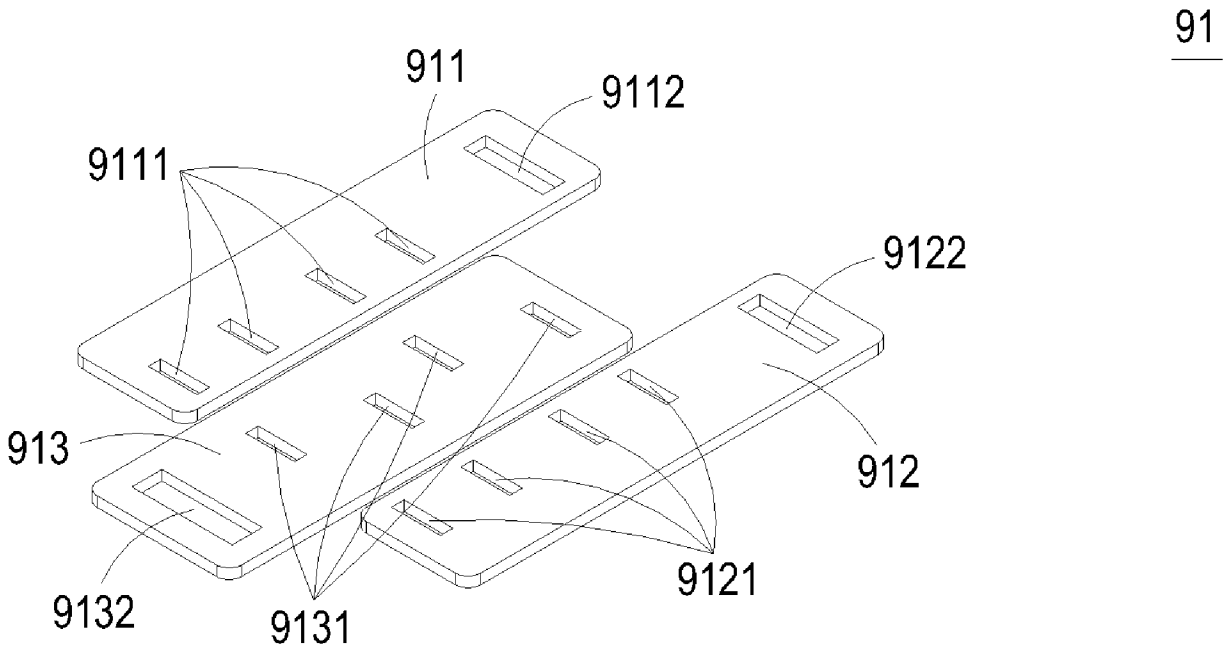
FIG. 19 is a schematic exploded view of the conductive base shown in FIG. 18.

FIG. 19 is a schematic exploded view of the conductive base shown in FIG. 18. In accordance with the present invention, the conductive base 91 comprises a plurality of conductive rods. In the embodiment of FIG. 18, the conductive base 91 comprises a first conductive rod 911, a second conductive rod 912 and a third conductive rod 913. The third conductive rod 913 is arranged between the first conductive rod 911 and the second conductive rod 912 so as to be electrically connected to the outlet part 231 of the inductor 23. In addition, the first conductive rod 911, the second conductive rod 912 and the third conductive rod 913 are disposed at the same level and form a surface thereon.

The first conductive rod 911, the second conductive rod 912 and the third conductive rod 913 have a plurality of first engaging holes 9111, 9121 and 9131, respectively, for inserting the plurality of conductive units 92 therethrough. The third conductive rod 913 further includes a second engaging hole 9132 for inserting the outlet part 231 of the inductor 23. Besides, each of the first conductive rod 911 and the second conductive rod 912 further includes a third engaging hole 9112 and 9122 for inserting pins 31 and 32 (shown in FIG. 22) of the circuit board 3.

Figure 20:
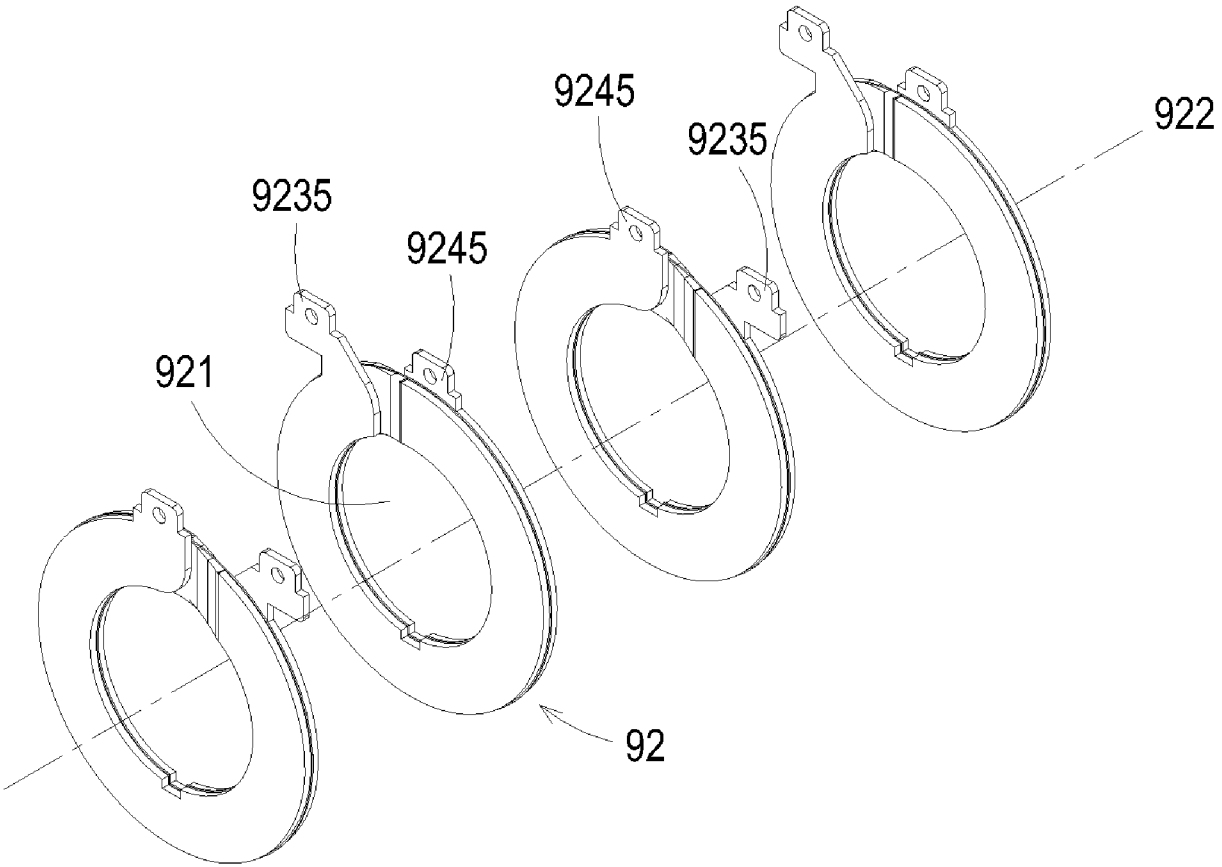
FIG. 20 is a schematic exploded view illustrating the plurality of conductive units shown in FIG. 18.
Figure 21:
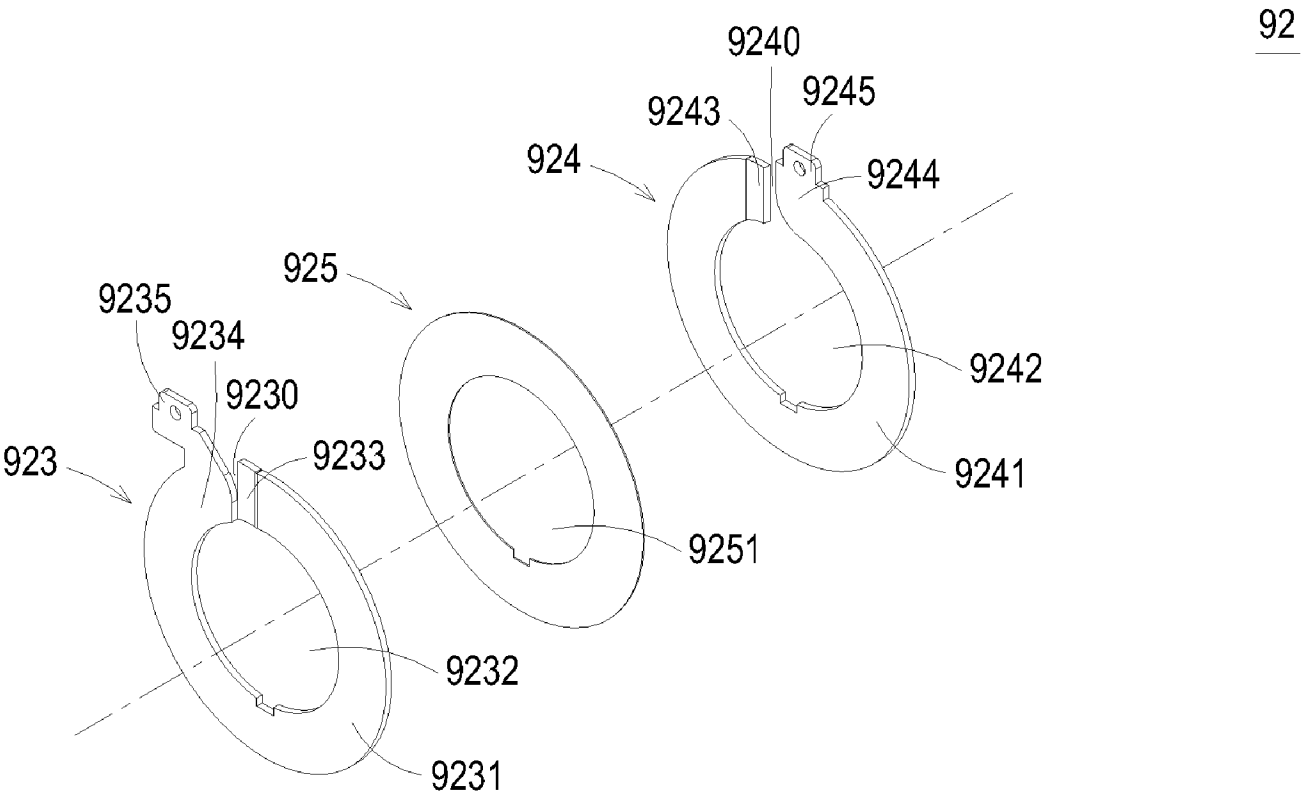
FIG. 21 is a schematic exploded view illustrating a single conductive unit shown in FIG. 20.

FIG. 20 is a schematic exploded view illustrating the plurality of conductive units shown in FIG. 18, and FIG. 21 is a schematic exploded view illustrating a single conductive unit shown in FIG. 20. Please refer to FIGS. 18 to 21. Each conductive unit 92 has a hollow portion 921 formed in the center thereof. These conductive units 92 are spaced from each other and fixed on the conductive base 91 at the same side where the inductor 23 is fixed on. As such, the hollow portions 921 of these conductive units 92 are aligned with each other to define a channel 922. In this embodiment, the conductive module 9 includes four conductive units 92; however, the number and the arrangement of the conductive units 92 may be modified or altered while retaining the teachings of the invention.

In some embodiment, each conductive unit 92 includes a first conductive piece 923, a second conductive piece 924 and an insulating piece 925. The insulating piece 925 is sandwiched between the first conductive piece 923 and the second conductive piece 924. The first conductive piece 923 has a ring-shaped, rectangle-shape or a polygon-shaped profile with a seam 9230 and is made of metallic material such as copper. The first conductive piece 923 includes a conductive body 9231. A hollow portion 9232 is formed in the center of the conductive body 9231. The first conductive piece 923 further comprises a first terminal 9233 and a second terminal 9234. The first terminal 9233 and the second terminal 9234 are disposed on bilateral sides of the seam 9230 and coupled with the conductive body 9231. The second terminal 9234 has an extension portion 9235 to be inserted into the first engaging hole 9111 or 9112 on the first conductive rod 911 or the second conductive rod 912.

Similarly, the second conductive piece 924 also has a ring-shaped, rectangle-shape or a polygon-shaped profile with a seam 9240 and is made of metallic material such as copper. The second conductive piece 924 includes a conductive body 9241. A hollow portion 9242 is formed in the center of the conductive body 9241. The second conductive piece 924 further comprises a first terminal 9243 and a second terminal 9244. The first terminal 9243 and the second terminal 9244 are disposed on bilateral sides of the seam 9240 and coupled with the conductive body 9241. The second terminal 9244 has an extension portion 9245 to be inserted into the first engaging hole 9131 on the third conductive rod 913.

The shape of the insulating piece 925 is substantially the same as the conductive body 9231 of the first conductive piece 923 and the conductive body 9241 of the second conductive piece 924. The insulating piece 925 also has a hollow portion 9251 formed in the center thereof. The insulating piece 925 is attached onto the conductive body 9231 of the first conductive piece 923 and/or the conductive body 9241 of the second conductive piece 924 via adhesive for example. The use of the insulating piece 925 may isolate the first conductive piece 923 from the second conductive piece 924. The hollow portion 9232 of the first conductive piece 923, the hollow portion 9242 of the second conductive piece 924 and the hollow portion 9251 of the insulating piece 925 are aligned with each other to define the hollow portion 921 of the conductive unit 92.

Please refer to FIG. 20 again. In this embodiment, the adjacent conductive units 92 are reversely arranged so that the extension portions 9235 on the first conductive pieces 923 of the two adjacent conductive units 92 are disposed on opposite sides which are close to the first conductive rod 911 and the second conductive rod 912, respectively. When mounting the plurality of conductive units 92 onto the conductive base 91, the two extension portions 9235 and 9245 of a single conductive unit 92 are respectively inserted into the first engaging hole 9111 of the first conductive rod 911 and the first engaging hole 9131 of the third conductive rod 913, and the two extension portions 9235 and 9245 of an adjacent conductive unit 92 are respectively inserted into the first engaging hole 9121 of the second conductive rod 912 and the first engaging hole 9131 of the third conductive rod 913. After the plurality of conductive units 92 are mounted on the conductive base 21, the outlet parts 231 of the inductor 23 are inserted into the second engaging hole 9132 of the third conductive rod 913. Meanwhile, the resulting conductive module 9 as shown in FIG. 18 is assembled.

Figure 22:
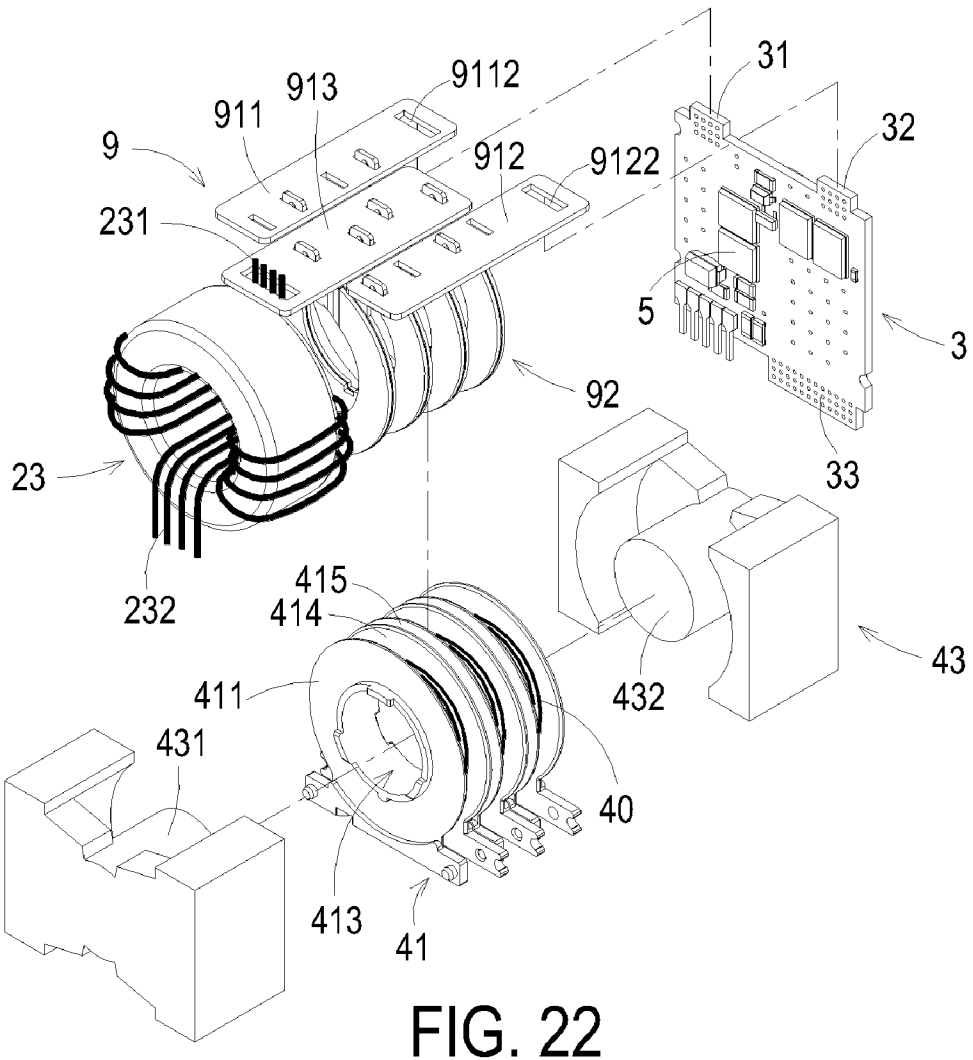
FIG. 22 is a schematic exploded view illustrating an assembly structure of the transformer and the inductor having the conductive module of FIG. 18.
Figure 23:
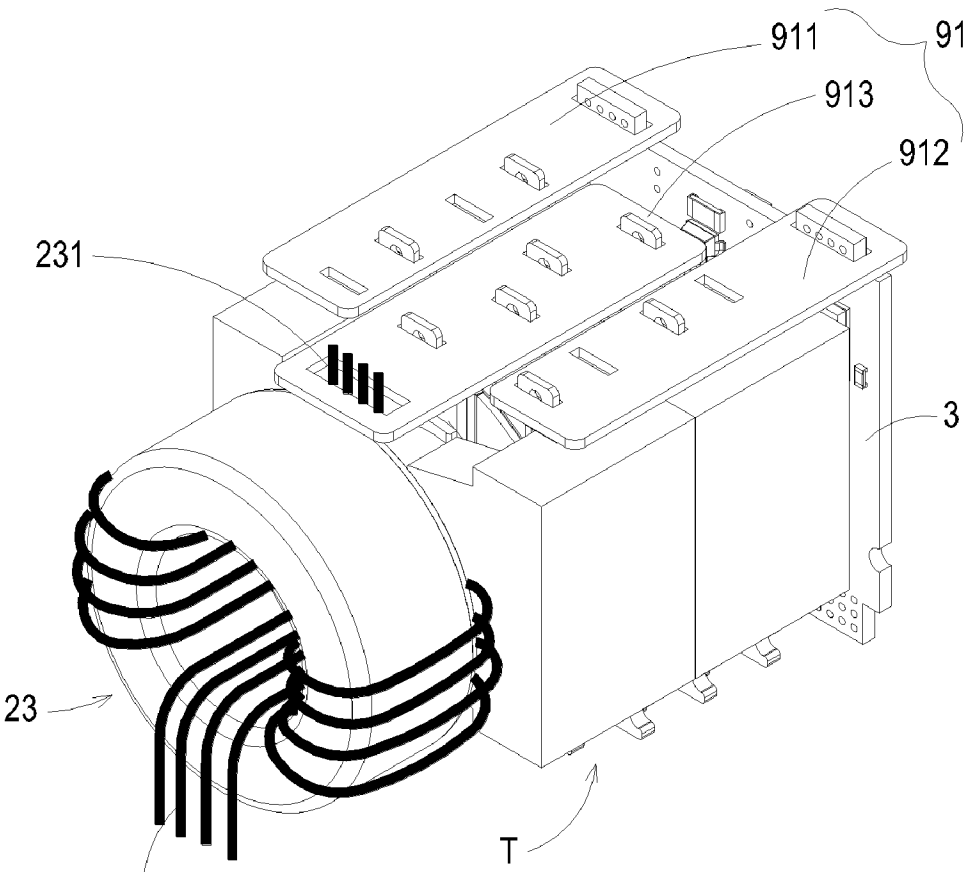
FIG. 23 is a schematic assembled view illustrating the assembly structure of FIG. 22.

FIG. 22 is a schematic exploded view illustrating an assembly structure of the transformer and the inductor having the conductive module of FIG. 18, and FIG. 23 is a schematic assembled view illustrating the assembly structure of FIG. 22. The assembly structure principally includes a primary winding coil 40, a bobbin 41, a conductive module 9 and a magnetic core assembly 43. The configurations of the primary winding coil 40, the bobbin 41 and the magnetic core assembly 43 are identical to those shown in FIG. 6, and are not redundantly described herein. In some embodiments, the assembly structure further includes at least one circuit board 3. The first conductive rod 911 and the second conductive rod 912 further includes respective third engaging holes 9112 and 9122, and the circuit boards 3 includes a first pin 31 and a second pin 32, which are used to be inserted into the third engaging holes 9112 and 9122 of the first conductive rod 911 and the second conductive rod 912, respectively. For example, at least one high power component 5 such as a transistor may be mounted on the circuit boards 3 by a fastening element (e.g. a screw and nut assembly) or according to a surface mount technology. As a consequence, the high power component 5 is electrically connected with the transformer through the trace patterns on the circuit boards 3. In this embodiment, the transformer T, the inductor 23 and the circuit board 3 are all disposed at the same side of the conductive base 91, wherein the transformer T is disposed between the inductor 23 and the circuit board 3.

Figure 24:
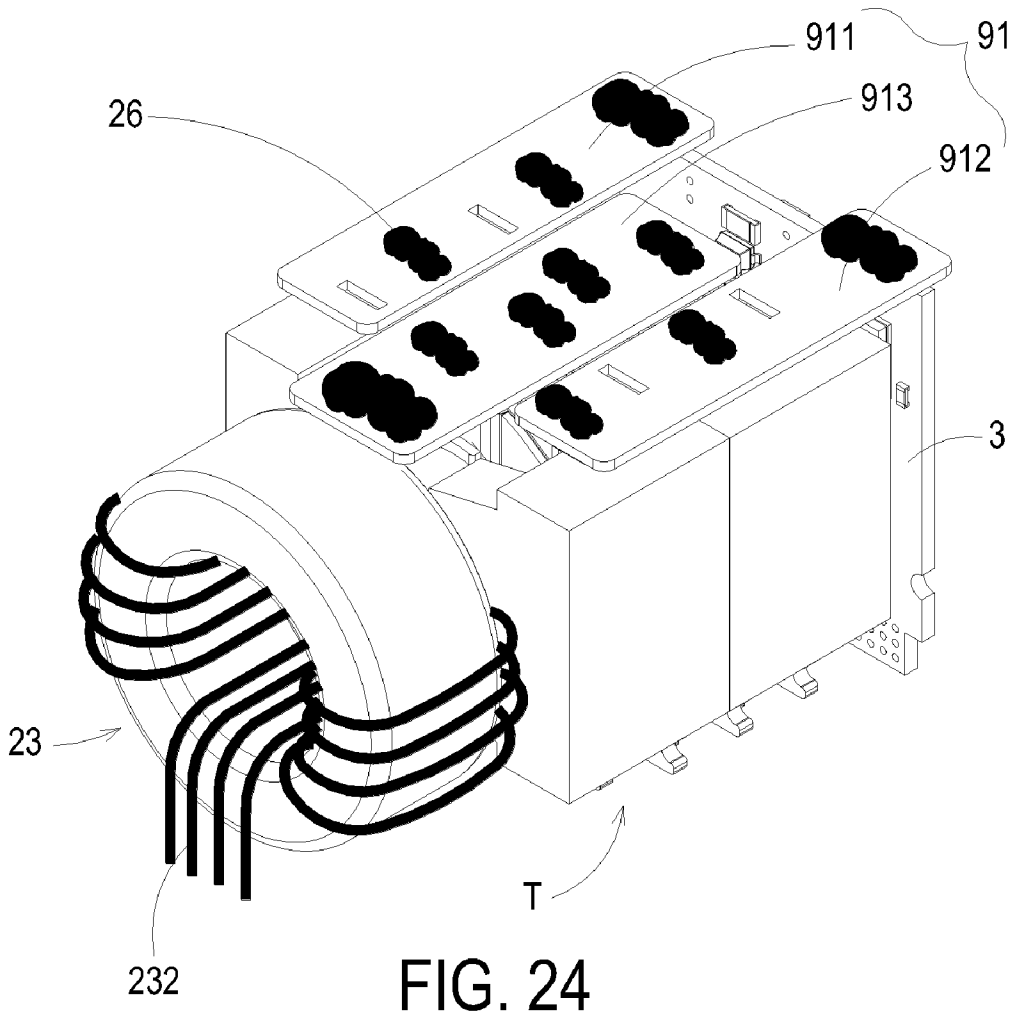
FIG. 24 is a schematic assembled view illustrating the assembly structure of FIG. 23 having solder paste.

Since the conductive units 92, the inductor 23 and the circuit board 3 are all mounted on the conductive base 91 through the first engaging holes 9111, 9121 and 9131, the second engaging hole 9132 and the third engaging holes 9112 and 9122, the extension portions 9235 and 9245 of the conductive units 92, the outlet part 231 of the inductor 23 and the pins 31 and 32 of the circuit board 3 can be firmly fixed on the conductive base 91 via solder paste 26 in a single flow soldering process (as shown in FIG. 24) by reflow oven (not shown in the figure). Therefore, the manufacturing process of the assembly structure of the transformer and the inductor can be simplified and the manufacturing cost can be reduced.

After the assembly structure of the transformer and the inductor is formed, the assembly structure can be further arranged on a system circuit board while the other outlet part 232 of the inductor 23 is coupled with a connecting part of a system circuit board and the circuit board 3 is inserted onto the system circuit board through a third pin 33. Since the inductor 23 is electrically connected to the output terminal of the secondary winding coil (i.e. the conductive unit 92) through the conductive base 91, no trace patterns need to be further designed on the system circuit board to connect the transformer T and the inductor 23. Therefore, the space utilization of the system circuit board can be enhanced and the power loss can be reduced. Certainly, the present technique can be utilized to assemble the transformer and other electronic components, but not limited to the inductor.

Moreover, since the first conductive rod 911, the second conductive rod 912 and the third conductive rod 913 of the conductive base 91 are disposed at the same level and form a surface thereon, the surface can also be provided as a heat-dissipation interface so that the heat generated from the transformer T, the inductor 23 and the circuit board 3 can be transferred to the surface of the conductive base 91, and further dissipated through the air. Thus, the heat-dissipation efficiency of the assembly structure can be increased.

Figure 25:
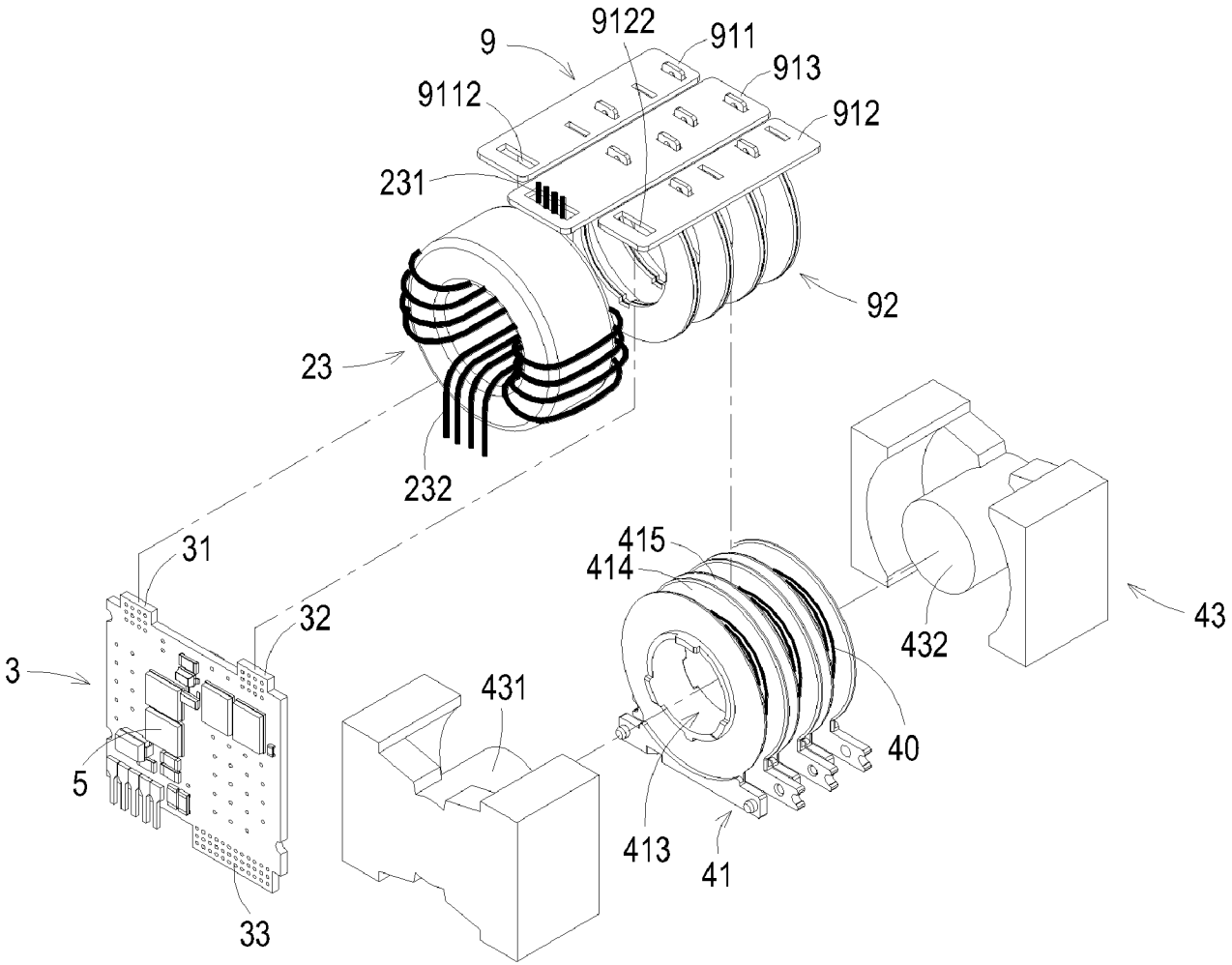
FIG. 25 is a schematic exploded view illustrating an assembly structure of the transformer and the inductor according to a further embodiment.
Figure 26:
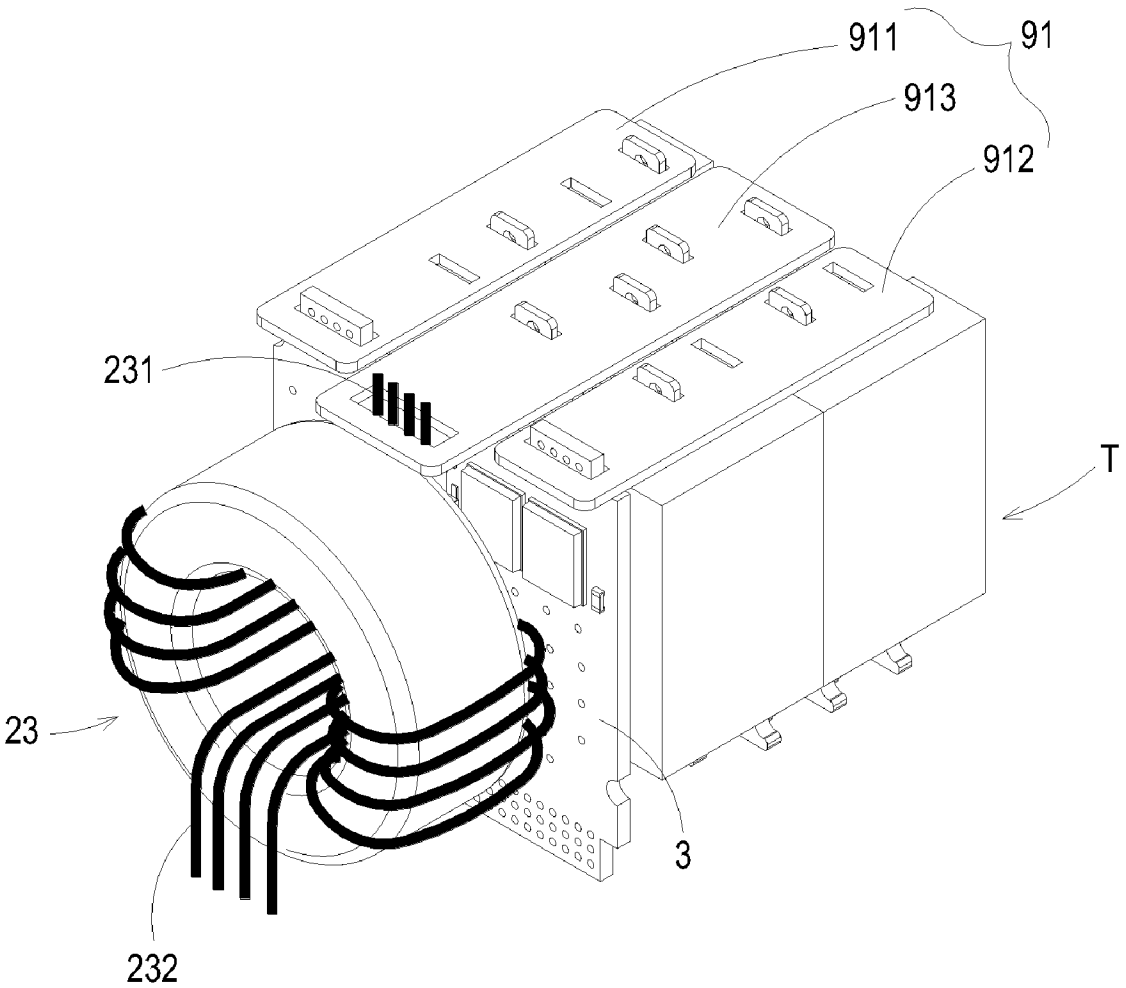
FIG. 26 is a schematic assembled view illustrating the assembly structure of FIG. 25.

FIG. 25 is a schematic exploded view illustrating an assembly structure of the transformer and the inductor according to a further embodiment, and FIG. 26 is a schematic assembled view illustrating the assembly structure of FIG. 25. The assembly structure of FIGS. 25 to 26 is similar to the assembly structure of FIGS. 22 to 23, and the difference therebetween is that the circuit board 3 in this embodiment is disposed between the transformer T and the inductor 23.

Figure 27:
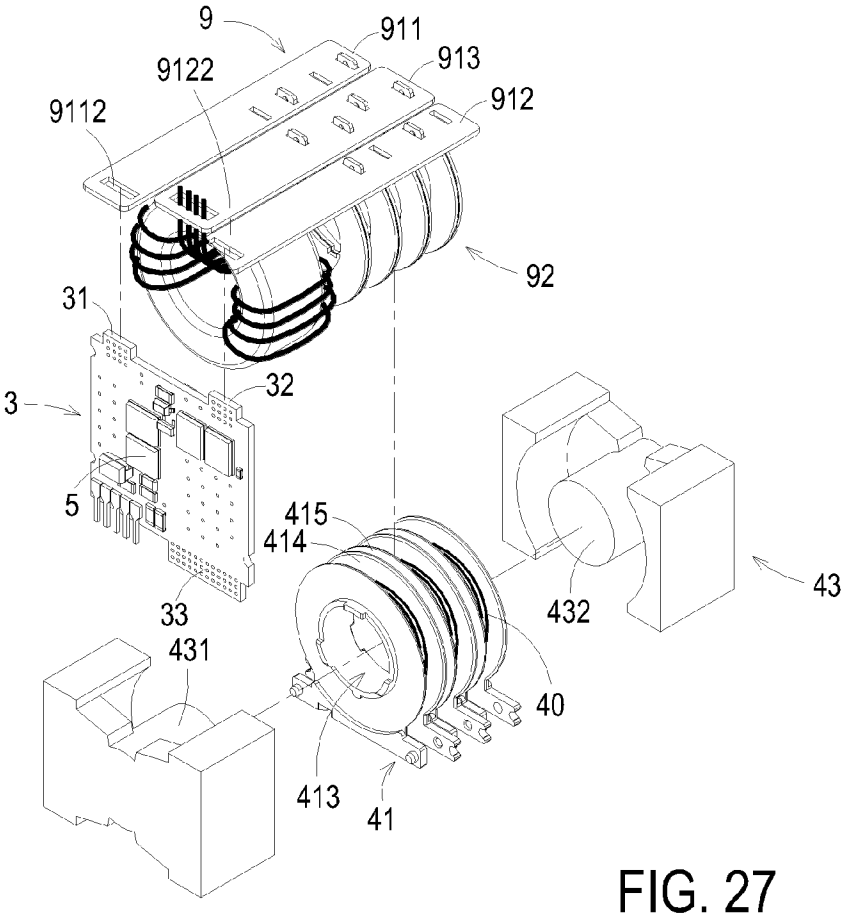
FIG. 27 is a schematic exploded view illustrating an assembly structure of the transformer and the inductor according to an additional embodiment.
Figure 28:
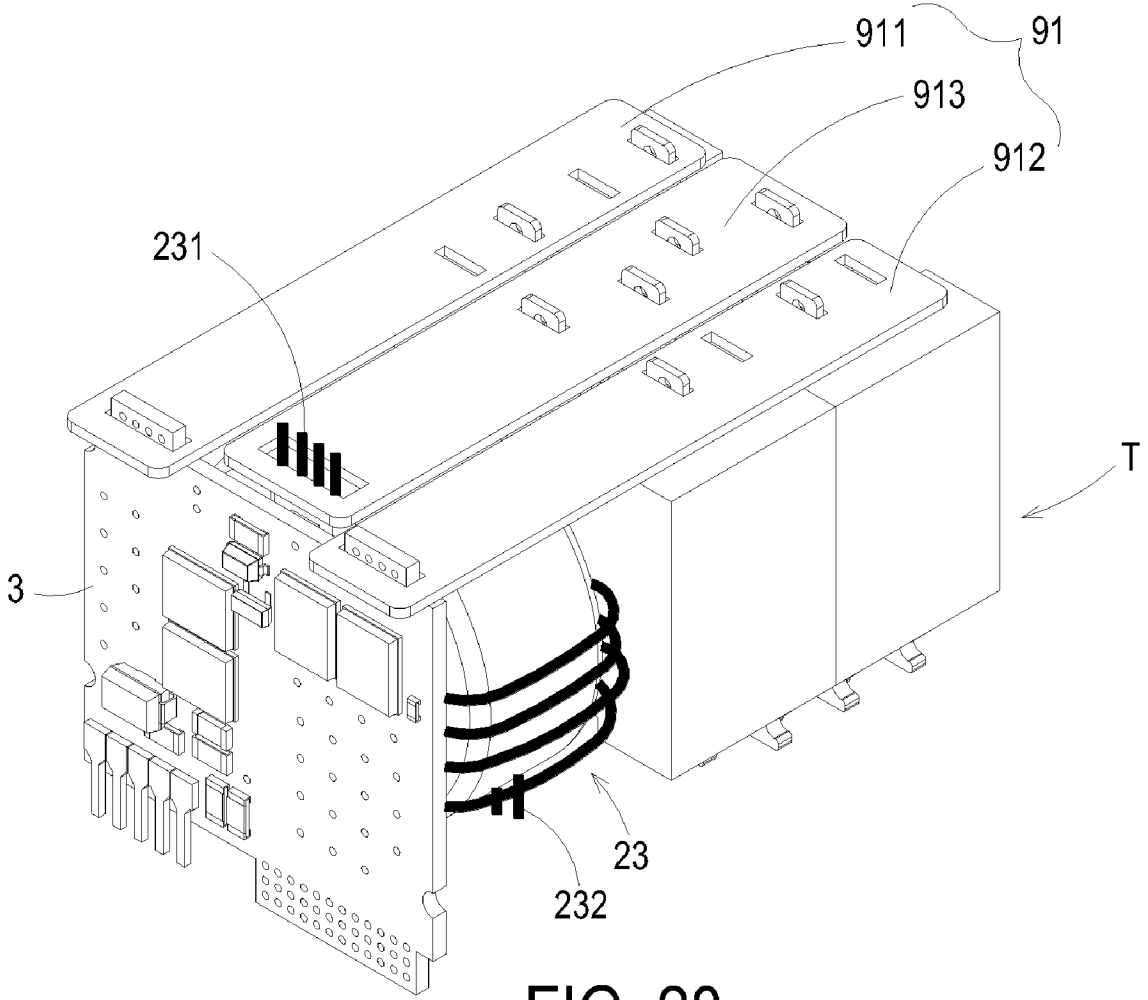
FIG. 28 is a schematic assembled view illustrating the assembly structure of FIG. 27.

FIG. 27 is a schematic exploded view illustrating an assembly structure of the transformer and the inductor according to an additional embodiment, and FIG. 28 is a schematic assembled view illustrating the assembly structure of FIG. 27. The assembly structure of FIGS. 27 to 28 is similar to the assembly structure of FIGS. 22 to 23, and the difference therebetween is that the circuit board 3 in this embodiment is disposed in the external side of the inductor 23, so that the inductor 23 is disposed between the transformer T and the circuit board 3.

Except to the arrangements described in the above embodiments, the arrangement of the transformer, the inductor and the circuit board can also be modified in different ways. For example, the circuit board may also be disposed at a lateral side of the transformer and the inductor. However, the modifications are within the spirit and scope of the present invention.

From the above description, the conductive module of the present invention is capable of coupling the transformer and the inductor without additional trace patterns. As a consequence, the space utilization of the system circuit board is enhanced. In addition, the conductive module of the present invention is advantageous for minimization and increased integration level of the electronic product. Since the conductive module is directly connected with the inductor without any additional trace patterns, the power loss is reduced. Moreover, the present invention also provides a simplified process for manufacturing an assembly structure of the transformer and the inductor, and the manufacturing cost can be reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A conductive module used for assembling a magnetic element, an inductor and a circuit board, said conductive module comprising:

a conductive base including a first conductive rod, a second conductive rod and a third conductive rod between said first conductive rod and said second conductive rod, wherein said first conductive rod, said second conductive rod and said third conductive rod are disposed at the same level and form a surface thereon;

said inductor electrically connected to said third conductive rod of said conductive base and disposed on one side of said conductive base; and a plurality of conductive units electrically connected to said first conductive rod, said second conductive rod and said third conductive rod and having respective hollow portions, wherein said conductive units are spaced from each other and fixed on said conductive base such that said hollow portions of said conductive units are aligned with each other to define a channel;

wherein said conductive units, said inductor and said circuit board are fixed on the same side of said conductive base.

2. The conductive module according to claim 1 wherein said magnetic element is a transformer.

3. The conductive module according to claim 1 wherein said third conductive rod is coupled with an outlet part of said inductor via solder paste, and said conductive units are fixed onto said conductive base via said solder paste.

4. The conductive module according to claim 3 wherein said third conductive rod has an extension part and said extension part of said third conductive rod is coupled with said outlet part of said inductor via solder paste.

5. The conductive module according to claim 4 wherein said extension part of said third conductive rod has an opening for penetrating said outlet part of said inductor therethrough, and said first conductive rod, said second conductive rod and said third conductive rod of said conductive base have several openings corresponding to said conductive units, wherein molten solder paste flows into said openings for enhancing soldering performance.

6. The conductive module according to claim 1 wherein each conductive unit comprises:

two conductive pieces, each of which is made of copper and includes a conductive body with a seam and a hollow portion formed in a center of said conductive body; and an insulating piece sandwiched between said two conductive pieces, wherein the shape of said insulating piece is substantially the same as said conductive body of said conductive piece, said insulating piece has another seam and another hollow portion, and said hollow portions of said conductive pieces and said hollow portion of said insulating piece are aligned with each other to define said hollow portion of said conductive unit.

7. The conductive module according to claim 6 wherein each conductive piece further comprises a first terminal and a second terminal, which are disposed on bilateral sides of said seam and coupled with said conductive body, wherein said first terminal has an engaging hole to be sheathed around said first conductive rod or said second conductive rod, said second terminal has an engaging notch, and said third conductive rod is received in the engaging notch such that said conductive piece is fixed on said conductive base.

8. The conductive module according to claim 6 wherein the outmost conductive pieces of first and last conductive units have respective extension side plates, which are disposed on bilateral sides of said inductor for supporting power components thereon.

9. The conductive module according to claim 1 wherein said inductor has a plurality of outlet parts and said outlet parts are coupled with said third conductive rod via solder paste.

10. The conductive module according to claim 1 wherein both of said first conductive rod and said second conductive rod include a plurality of first engaging holes and a third engaging hole, and said third conductive rod includes said plurality of first engaging holes and a second engaging hole.

11. The conductive module according to claim 10 wherein said conductive units are inserted into said first engaging holes and fixed onto said conductive base via solder paste and an outlet part of said inductor is inserted into said second engaging hole and fixed onto said conductive base via solder paste.

12. The conductive module according to claim 11 wherein a said circuit board is inserted into said third engaging holes and fixed onto said conductive base via solder paste.

13. The conductive module according to claim 1 wherein said conductive units, said inductor and said circuit board are soldered onto said conductive base in a single flow soldering process.

14. An assembly structure of a transformer, an inductor and a circuit board, comprising:

a primary winding coil;

a conductive module used for assembling said transformer, said inductor and said circuit board, said conductive module including a conductive base, said inductor and a plurality of conductive units, said conductive base including a first conductive rod, a second conductive rod and a third conductive rod between said first conductive rod and said second conductive rod, wherein said first conductive rod, said second conductive rod and said third conductive rod are disposed at the same level and form a surface thereon, said inductor being electrically connected to said third conductive rod of said conductive base and disposed on one side of said conductive base, said conductive units electrically connected to said first conductive rod, said second conductive rod and said third conductive rod of said conductive base and having respective hollow portions, wherein said conductive units are spaced from each other and fixed on said conductive base such that said hollow portions of said conductive units are aligned with each other to define a first channel;

a bobbin comprising a main body having a second channel therein, one or more winding sections arranged on said main body for winding said primary winding coil thereon, and one or more receiving portions arranged on said main body for accommodating said conductive units of said conductive module;

a magnetic core assembly partially embedded into said first channel of said conductive module and said second channel of said bobbin; and said circuit board electrically connected to said first conductive rod and said second conductive rod of said conductive base;

wherein said conductive units, said inductor and said circuit board are fixed on the same side of said conductive base.

15. The assembly structure according to claim 14 wherein said conductive units of said conductive module form a secondary winding coil.

16. The assembly structure according to claim 14 wherein the distance between any two adjacent conductive units is greater than or equal to the width of each winding section.

17. The assembly structure according to claim 14 wherein said receiving portion has an entrance, and the cross-sectional length of said entrance is substantially greater than the diameter of said conductive unit such that said conductive unit is inserted into said receiving portion through said entrance.

* * * * *